US012419377B1

(12) United States Patent
Knaus et al.

(10) Patent No.: US 12,419,377 B1
(45) Date of Patent: Sep. 23, 2025

(54) PROTECTIVE HELMET

(71) Applicants: Dennis A. Knaus, Malvern, PA (US); John T. Desko, Syracuse, NY (US)

(72) Inventors: Dennis A. Knaus, Malvern, PA (US); John T. Desko, Syracuse, NY (US)

( * ) Notice: Subject to any disclaimer, the term of this patent is extended or adjusted under 35 U.S.C. 154(b) by 228 days.

(21) Appl. No.: 17/939,201

(22) Filed: Sep. 7, 2022

Related U.S. Application Data

(60) Provisional application No. 63/279,876, filed on Nov. 16, 2021.

(51) Int. Cl.
*A42B 3/06* (2006.01)
*A42B 3/20* (2006.01)
*A42B 3/32* (2006.01)

(52) U.S. Cl.
CPC ..... *A42B 3/063* (2013.01); *A42B 3/20* (2013.01); *A42B 3/326* (2013.01)

(58) Field of Classification Search
CPC ..... A42B 3/063; A42B 3/127; A42B 3/064; A42B 3/125
See application file for complete search history.

(56) References Cited

U.S. PATENT DOCUMENTS 3,994,022 A * 11/1976 Villari ..... A42B 3/121 2/909
6,883,183 B2 * 4/2005 Morrow ..... A42B 3/08 2/9
7,240,376 B2 * 7/2007 Ide ..... A42B 3/122 2/425
9,345,282 B2 * 5/2016 Durocher ..... A63B 71/10
9,743,702 B2 * 8/2017 Warmouth ..... A42B 3/20
9,943,129 B2 * 4/2018 Newman ..... A42B 3/20
10,932,514 B2 * 3/2021 Ide ..... A42B 3/20
2004/0261157 A1 * 12/2004 Talluri ..... A42B 3/069 2/412
2013/0067645 A1 * 3/2013 Musal ..... A63B 71/10 2/424

(Continued)

FOREIGN PATENT DOCUMENTS

CN 107048566 A * 8/2017
CN 109123876 A * 1/2019 ..... A42B 3/06

(Continued)

*Primary Examiner* — Tajash D Patel
(74) *Attorney, Agent, or Firm* — Andrew L. Salvatore, Esquire

(57) ABSTRACT

A protective helmet comprising a helmet shell having at least two layers and the helmet shell having a flexural modulus from 50 MPa to 600 MPa as measured using ASTM D 790 B and a non-foamed specific gravity in the range of 0.916 g/cm$^3$ up to 1.60 g/cm$^3$. More than one helmet shell may be combined to provide greater protection to the wearer. The layers may be constructed of an open cell foam, a waterproof coating layer, a separator layer, a flexible layer, a slightly foamed layer, and a cushion layer. A protective facial barrier may be easily removed with use of a locking mechanism which removably secures the facial barrier to the helmet shell. The helmet shells may also be in parts and hinged so that the parts can separate for easy removal of the protective helmet. An adjustment locking mechanism may also tighten and adjust a second helmet shell.

17 Claims, 14 Drawing Sheets

(56) References Cited

U.S. PATENT DOCUMENTS

| | | | | |
|---|---|---|---|---|
| 2014/0223644 | A1* | 8/2014 | Bologna | A42B 3/205<br>2/414 |
| 2016/0360818 | A1* | 12/2016 | Riina | A42B 3/08 |
| 2017/0127748 | A1* | 5/2017 | Sethumadhavan | B32B 5/245 |
| 2018/0255862 | A1* | 9/2018 | Ho | A42B 3/064 |
| 2018/0317589 | A1* | 11/2018 | Mestas | A42B 3/064 |

FOREIGN PATENT DOCUMENTS

| | | | | |
|---|---|---|---|---|
| EP | 4029683 | A1 * | 7/2022 | A42B 3/064 |
| WO | WO-2009069553 | A1 * | 6/2009 | G02F 1/1303 |
| WO | WO-2016204499 | A1 * | 12/2016 | A42B 3/061 |
| WO | WO-2022002929 | A1 * | 1/2022 | A42B 3/127 |

* cited by examiner

PROTECTIVE HELMET

CROSS REFERENCE TO RELATED APPLICATIONS

This application claims priority to provisional application Ser. No. 63/279,876 filed on Nov. 16, 2021. The above referenced prior application is hereby incorporated herein by reference.

BACKGROUND OF THE INVENTION

Field of Invention

The invention relates to a protective helmet 21 for athletic activities and non-athletic activities and the design and composites of materials used to fabricate such helmets. Chronic Traumatic Encephalopathy (CTE) is brain degeneration likely caused by repeated head traumas. It is not related to the immediate consequences of a late-life episode of head trauma. CTE has a complex relationship with head traumas such as persistent post-concussive symptoms and second impact syndrome that occur earlier in life.

Experts are trying to understand the effect of repeated Traumatic Brain Injury (TBI) including concussions and repeated blows to the head. TBI is associated with the development of dementia. Studies have shown that people who experience TBI in early to midlife are two to four times more at risk of developing dementia in late life. This risk appears to be much higher in people with several TBIs and may contribute to the changes in the brain that result in CTE.

CTE has been found in the brains of people who played football and other contact athletic activities, including boxing. It may also occur in military personnel who were exposed to explosive blasts. Some signs and symptoms of CTE are thought to include difficulties with cognition and emotions, physical problems, and other behaviors. It is thought that these behaviors develop years to decades after head trauma occurs. CTE cannot be made as a diagnosis during life except in those rare individuals with high-risk exposures. Researchers do not yet know the frequency of CTE in the population. There is no cure for CTE.

Micro-concussions aren't noticeable like a significant impact or "big hit" to the head where people could assume a possible concussion has occurred. A single micro-concussion is not likely to have the same effects as a concussion, but multiple micro-concussions may lead to CTE or over a small window of time can lead to a full-blown concussion.

In certain activities, there is a risk of an impact force to the head that can result in an injury. This may occur due to a collision with other players, or an impact force to the head from equipment used in athletic activities such as a bat, stick, puck or ball, the ground, an ice surface, a goal post, a physical boundary such as the boards around a hockey rink, or hard natural features or surfaces such as the ground or stones, to name a few. In some athletic activities, players are required to wear a protective helmet to protect against head injuries. In other athletic activities, such as soccer, a protective helmet is not traditionally worn, but the protective helmet 21 design disclosed herein can provide protection from an impact force as well as mitigate the impact force that occurs when colliding with another player, object, or a player's head hitting a soccer ball, referred to as "heading" the ball, that could cause long term problems with brain cognitive functions. In addition, some people have medical problems which make them prone to falling. Wearing the protective helmet 21 disclosed herein could decrease the impact energy to the wearer's head and reduce the severity of, or eliminate a head injury.

DESCRIPTION OF THE PRIOR ART

The protective helmet 21 design of the invention can mitigate or reduce the effects of an impact force to a wearer's head. The protective helmet 21 design is substantially different than current helmet designs that have a rigid layer external head-protecting shell, herein after referred to as a "rigid layer shell". The rigid layer shell of the invention can have a specific gravity ranging from 916 kg/m$^3$ up to 1600 kg/m$^3$ as determined using ASTM D792 and with a Flexural Modulus greater than 600 MPa as measured using ASTM D 790 B. The rigid layer shell transfers the energy from an impact force to a cushion layer 2 of material in contact with the rigid layer shell that is intended to mitigate the energy to the wearer's head. By contrast, in prior art helmets, the cushion layer 2 of material inside and in direct contact with the rigid layer shell and wearer's head, is typically firm and hard and does not provide sufficient or adequate spreading of the energy from the impact force over a larger area to reduce the force per square inch (lbs./square inch or psi). Thus, the current helmet designs do very little to dissipate or mitigate the energy of an impact force, thus, providing only minimal protection to the helmet wearer from impact forces that can cause, for example, a concussion.

A hard or rigid material should not be used to make a protective helmet because a hard or rigid material does not significantly reduce the rate of deceleration of the energy from an impact force. A hard or rigid material does not distribute the energy of an impact force over a larger area of the helmet to reduce the impact energy intensity per square inch area, and a hard or rigid material does not significantly absorb the energy of an impact force. A hard or rigid material does not significantly mitigate the energy of an impact force, but it transfers the energy from an impact force to the inside layer in contact with the shell.

A hard rigid shell mimics or functions like the "Newton's Cradle", which is a device that demonstrates the conservation of momentum and the conservation of energy with swinging spheres. When one sphere at the end is lifted and released, it strikes the stationary spheres, transmitting a force through the stationary spheres that pushes the last sphere upward. The last sphere swings back and strikes the nearly stationary spheres, repeating the effect in the opposite direction. The device is named after 17th-century English scientist Sir Isaac Newton and designed by French scientist Edme Mariotte. It is also known as Newton's pendulum, Newton's balls, Newton's rocker or executive ball clicker (since the device makes a click each time the balls collide, which they do repeatedly in a steady rhythm).

Like the spheres of a Newton's Cradle, a helmet that has a rigid layer shell does not spread the energy from an impact force over a larger area to dissipate and mitigate the energy from the impact force. To the contrary, the energy from the impact force is focused within a finite area where the impact force occurs. Like Newton's Cradle, most of the energy from an impact force against a rigid layer shell helmet is transferred to a cushion layer in contact with the wearer's head. In current helmets, the cushion layer is often a hard polystyrene foam or a firm polyethylene foam that does not provide suitable cushioning to mitigate the energy from an impact force. These types of foams transfer a substantial amount of the energy from an impact force to the helmet wearer's head. A single impact force or repeated impact forces as described could cause a series of micro-concussions, or a concussion. The accumulative effect of such impacts to a wearer's head could lead to long term degradation of cognitive functions. Impact to the head can result in TBI and CTE.

U.S. Pat. No. 10,932,514 B2 recommends the use of LEXAN®, a polycarbonate as a preferred material to make a protective helmet shell. Lexan has a Flexural Modulus of about 2,585 MPa. Polycarbonate's Flexural Modulus is substantially greater than 600 MPa which makes it too rigid and "hard". Polycarbonate is used to make bullet "proof glass". In U.S. Pat. No. 10,932,514 B2, more than one shell layer is mentioned, but the layers overlap or intersect to form a single contiguous shell layer, not a separate shell layer or multiple layers. U.S. Pat. No. 10,932,514 B2 uses a multitude of interconnecting chambers and channels with fluid, such as air. An impact force will compress this structure of chambers and channels and in turn increase the fluid pressure in the chambers and channels making this structure less effective as a cushioning layer. U.S. Pat. No. 10,932,514 B2 also cites its cushion layer as a PVC nitrile foam or a flexible polyurethane foam, having a density of at least approximately 5 PCF (pounds per cubic foot). A foam density of 5 PCF (pounds per cubic foot) may or may not be acceptable. The foam density of a cushion layer is not necessarily a relevant value. ASTM 3574 is the Standard Test Methods for Flexible Cellular Materials-Slab, Bonded, and Molded Urethane Foams. Urethane foam is generally defined as an expanded cellular product produced by the interaction of active hydrogen compounds, water, and isocyanates. There are several test procedures in ASTM 3574 to help determine the compression, deflection, tear, and tensile characteristics of flexible cellular materials (urethane foams and polyurethane foams). Indentation force deflection/indentation load deflection (IFD/ILD) is the most common compression test in this test standard and one that is the most relevant to test polyurethane foam for its effectiveness and cushion protective properties as well as its ability to absorb the energy of an impact force and not transfer it to the wearer's skull, which can result in trauma to the brain, such as a micro-concussion or concussion. ASTM D3574 should be used to quantify compression and Indentation Force Deflection (IFD) of a foam to determine its acceptability. Foam density and Shore Durometer Number should not be a qualifying standard. Accordingly, U.S. Pat. No. 10,932,514 B2 teaches a helmet which is too rigid and will not adequately absorb impact energy to protect the wearer from injury.

U.S. Pat. No. 9,943,129 states that the external head-protecting shell is soft to reduce the risk of injuring other players. The shell is not soft to reduce the risk of injuring the wearer of the helmet. Furthermore, the patent does not quantify "soft". Rather the patent describes and defines the shell by its surface hardness using Shore A and Shore D numbers, which are durometer numbers, and these are dimensionless measurements. The Durometer device measures the depth of penetration of the indenter into the material determines the hardness value of the material. The Durometer test cannot predict a material's cushioning properties whether the material is the Helmet Shell 9 or Cushion Layer 2. The higher a Durometer Shore number simply means the penetration of the indenter of the Shore Testing instrument is less. Again, ASTM D3574 should be used to quantify IFD/ILD (Indentation force deflection/indentation load deflection) of a foam to determine its acceptability. The Durometer Shore Number of a helmet shell or cushion layer does not necessarily relate to a suitable material for helmet shell or cushion layer that will enable more energy of the impact force to be transferred to the next layer. U.S. Pat. No. 9,943,129 does not define bending flexibility of the material to make a soft helmet shell. Flexibility or the Flexural Modulus of the shell material, not the Durometer Shore number, is critical in designing a protective helmet to maximize its ability to absorb and mitigate the energy from an impact force, and protect the wearer's brain.

The Flexural Modulus of a material is a mechanical property that measures a material's stiffness or resistance to a bending action. Furthermore, a material's surface can be hard and have a very high Shore number, but the material can be flexible, which is why the only meaningful number in describing a material used to make the shell of a headgear (helmet) is its Flexural Modulus. In FIG. 7 of U.S. Pat. No. 9,943,129 the primary padding comprises three layers of different materials. The outermost layer which is the layer closest to the external head-protecting shell, has the highest Shore D hardness. A middle layer has a lower Shore D hardness than that of outermost layer, but a higher Shore D hardness than that of an innermost layer. Innermost layer, which is the layer closest to the wearer's head when the headgear (helmet) is worn, has the lowest Shore D hardness. Again, the use of Shore numbers to describe the shell and cushioning materials are meaningless and have no relevant value. However, where a foam is more rigid, more energy of the impact force will be transferred to the next foam layer and the foam layers will not be as effective in absorbing and mitigating the energy from an impact force. ASTM D3574 should be used to quantify IFD/ILD (Indentation force deflection/indentation load deflection) of a foam to determine its acceptability. Instead, with the device of U.S. Pat. No. 9,943,129, much of the energy will be transferred to the skull of the wearer of the headgear (helmet). This is contrary to the method disclosed in this patent application.

U.S. Pat. No. 9,345,282 recommends using rigid materials, such as polyethylene, NYLON, polycarbonate materials, thermoplastics, or thermosetting resins or any other suitable material to use as materials to make a protective helmet shell. NYLON has a Flexural Modulus of about 2,300 MPa and polycarbonate, used to make "bullet proof glass", has a Flexural Modulus of about 2,585 MPa. Thermosetting resins are rigid and hard, and have a Flexural Modulus of about 3,000 MPa, which makes them poor choices to use as materials to make a protective helmet shell. The Flexural Modulus of these materials are substantially greater than 600 MPa and unsuitable as materials for a protective helmet shell. Although U.S. Pat. No. 9,345,282 suggests using "Polyethylene" as a material to make a protective helmet shell. There are several types of polyethylene, and none specifically were name or specified by their physical properties in U.S. Pat. No. 9,345,282. The properties of thermoplastic like polyethylene are determined using several test methods. Its specific gravity or density are determined using ASTM D792, Specific gravity means a measure of the mass ratio of a given substance volume at 23° C. of the same deionized water volume. Density is the mass of a substance per unit volume. There are several different "polyethylenes", including LDPE (low-density polyethylene) that has a specific gravity of 0.910-0.925 g/cm$^3$ or a density of 910-925 kg/m$^3$, LLDPE (linear low-density polyethylene) that has a specific gravity of 0.910-0.940 g/cm$^3$ or a density of 910-940 kg/m$^3$, MDPE (medium-density polyethylene) that has a specific gravity of 0.916-0.940 g/cm$^3$ or a density of 916-940 kg/m$^3$ and HDPE (high density polyethylene) that has a specific gravity of 0.941-0.965 g/cm$^3$ and density of 941-965 kg/m$^3$. The specific gravities of the aforementioned polyethylenes are not foamed. The patent also cites High- Density Polyethylene (HDPE) foam, which is very rigid and hard like polypropylene (EPP) foam, making it unsuitable as a cushioning material in a helmet because it will transfer the energy from an impact force to the wearer's skull. ASTM D3574 should be used to quantify IFD/ILD (Indentation force eflection/indentation load deflection) of a foam to determine its acceptability. HDPE is rigid and has a Flexural Modulus of about 1,000 MPa, which is substantially above 600 MPa and makes High Density Polyethylene a poor choice to use as a material to make a protective helmet shell. In the patent more than one shell layer is mentioned, but the layers overlap or intersect to form a single contiguous shell, not a separate second layer shell or multiple layer shells. U.S. Pat. No. 9,345,282 also suggests using expanded polypropylene (EPP) or expanded polyethylene (EPE) as a cushion layer. Both EPP and EPE are foams. Expanded polypropylene (EPP) foam is not suitable to use as a cushion layer in a helmet to absorb sufficient energy from an impact force. It is too rigid and inflexible and is used to make car bumpers. EPP foam would transfer most of the energy from an impact force to the wearer's skull. While expanded polyethylene (EPE) foam is more flexible than expanded polypropylene (EPP), expanded polyethylene (EPE) foam is not flexible or soft enough and not suitable to use for absorbing the energy from an impact force in a helmet encountered in a typical athletic event, because expanded polyethylene (EPE) foam will transfer too much energy to the wearer's skull. In addition, EPE is a closed cell foam and when its cells are compressed, the air pressure in the cells increases, making the foam harder and more resistant to the compression force and this reduces the EPE foam effectiveness as a cushioning material. After repeated compression events, the expanded polyethylene (EPE) foam would eventually develop compression set and ruptured cells meaning its thickness will permanently decrease making the foam more dense, rigid and hard, and less effective as a cushion layer material, which would require the foam to be replaced. Accordingly, U.S. Pat. No. 9,345,282 will not effectively absorb impact energy to protect the wearer.

U.S. Pat. No. 6,883,183 mentions using a hard outer shell that covers some type of energy absorbing material. The hard outer shell of most sport helmets is typically comprised of a plastic material. As previously mentioned, if a helmet's outer shell is made of a hard or rigid material, the energy from an impact remains concentrated in a finite area and most or all of the energy is transferred to the layer in contact with the shell, which is typically a cushion layer that is too rigid and does not sufficiently absorb impact forces. U.S. Pat. No. 6,883,183 cites the use of polystyrene foam and polypropylene foam pads. Typically, these foams are too rigid and polypropylene foam is used for car bumpers. These foams do not mitigate the energy from an impact force, but transfer most of the energy of an impact force to the wearer's skull like the Newton's Cradle mechanism, which could result in trauma to the brain, such as a micro-concussion or concussion.

U.S. Pat. No. 7,240,376 recommends using LEXAN® a polycarbonate. As mentioned, polycarbonate is rigid and inflexible, has a Flexural Modulus of about 2,585 MPa and is used to make bullet "proof glass" and will not mitigate the energy from and impact force, but transfer it to the cushion layer in a finite area. U.S. Pat. No. 7,240,376 recommends using a cushion layer comprised of PVC nitrile foam, rubber foam, or flexible polyurethane foam as examples of foam padding materials and says the foam should have a density of at least approximately 5 PCF (pounds per cubic foot). Using foam density is not a meaningful method of determining a foam's suitability as a cushioning material. ASTM D3574 should be used to quantify compression and Indentation Force Deflection (IFD) of a foam to determine its acceptability. If the foam compression and Indentation Force Deflection (IFD) are too high it will not sufficiently mitigate the energy from an impact force, but transfer the energy of an impact force to the wearer's skull like the Newton's Cradle mechanism, which could result in trauma to the brain, such as a micro-concussion or concussion.

In contrast, the helmet design disclosed herein will mitigate impact forces to the head and possibly the risk of TBI and the trauma that may cause CTE. In addition, the helmet design disclosed herein can be worn to protect individuals that have balance problems and are susceptible to falling or someone who has seizures.

SUMMARY OF THE INVENTION

Essentially, all current helmets use a hard rigid layer shell with a Flexural Modulus greater than 600 MPa and ASTM D3574 should be used to quantify the compression and Indentation Force Deflection (IFD) of a foam to determine its acceptability as a foam cushion layer. The implied intent of most helmets is to mitigate head injuries and in contact sports like football, hockey, and lacrosse, to name a few. The injuries can be abrasions and cuts, to the face, eyes and head, as well as skull fractures, and concussions. Concussions occur when the brain hits the skull or when the skull hits the brain.

Helmets should strive to reduce the rate of deceleration of the skull and brain, distribute the energy of an impact force over a larger area of the helmet to reduce the energy intensity per square inch area, and absorb the energy of an impact force. A helmet should be designed to achieve the maximum mitigation of the energy from an impact force to protect the brain of the helmet wearer.

If a protective helmet shell is made of a hard or rigid material with a Flexural Modulus greater than 600 MPa, the energy from an impact force remains concentrated in a finite area where the impact force occurs and most or all of the energy is transferred to the layer of material in contact with the hard or rigid shell, which is usually a cushion layer of rigid foam or a compartment filled with a fluid such as air or a liquid which maintains its rigidity because it is contained within a finite compartmental area. In a helmet with a rigid shell, the cushion layer must absorb essentially all of the energy from an impact force in a finite area. The energy of the impact force that is not absorbed by the cushion layer is transferred to the skull of the helmet wearer, which could cause trauma to the brain, such as a micro-concussion or concussion.

The protective helmet 21 of the invention may be comprised of one or more contiguous helmet shells 9 that are parallel, approximately parallel or mounted, stacked, or contained within another helmet shell 9 and with each helmet shell 9 having an associated cushion layer 2. Any of the cushion layers 2 may be a foam comprised of polystyrene, polypropylene, polyethylene, thermoplastic polyurethane (TPU), thermoplastic elastomers (TPE), silicone polymers, EPDM polymers, natural rubber, and neoprene. Flexible polyurethane foams may be prepared by the reaction of a diisocyanates or polyisocyanates with a polyol in the presence of a blowing agent, a surfactant, and a catalyst with or without external heating during its foaming. ASTM D3574 should be used to quantify Indentation force reflection/indentation load deflection (IFD/ILD) of a foam to determine its acceptability. Polystyrene and polypropylene tend to be more rigid; however, when crosslinked with low density polyethylene foam, may be less rigid and suitable to adequately absorb energy from an impact. In a preferred embodiment, the foam is made of a flexible polyurethane foam with open cells.

In a preferred embodiment, several different polyethylenes are less rigid and may adequately be used as a layer of the helmet shell 9: for instance, low density polyethylene (LDPE) that has a specific gravity of 0.910-0.925 g/cm$^3$ or density of 910-925 kg/m$^3$ linear low density polyethylene (LLDPE) that has a specific gravity of 0.910-0.940 g/cm$^3$ or density of 910-940 kg/m$^3$.

Cushion layer 2 may also be a crosslinked Ethylene-Vinyl Acetate (EVA) Copolymer. The specific gravity of a non-foamed Ethylene-Vinyl Acetate (EVA) Copolymer range 0.916 g/cm$^3$ to 0.940 g/cm$^3$ or density 916 kg/m$^3$ to 940 kg/m$^3$ such as Dow Elvax® 670 Ethylene-Vinyl Acetate Copolymer Resin. Ideally, these foams are crosslinked and have open cells. Each of these may be suitable materials for construction of cushion layer 2. High density polyethylene (HDPE) that has a specific gravity of 0.941-965 g/cm$^3$ or density of 941-965 kg/m$^3$ and medium density polyethylene (MDPE) that has a specific gravity of 0.916-0.940 g/cm$^3$ or density of 916-940 kg/m$^3$ and are less desirable for cushion layer 2 because they are very rigid and "hard" like Polypropylene foam and absorb very little energy from an impact force and transfer most of the energy to the wearer's skull, which can result in trauma to the brain, such as a micro-concussion or concussion. Copolymers of these materials (e.g. polystyrene, polypropylene, polyethylene, thermoplastic polyurethane (TPU), thermoplastic elastomers (TPE), silicone polymers, EPDM polymers, natural rubber, and neoprene) which maintain a less rigid structure may also be used. Ideally, these materials would be crosslinked, foamed, and have open cells.

Another factor affecting the rigidity and flexibility of a foam is whether it is a closed cell foam or an open foam cell. Closed cell foams are made up of cells that are irregular non-uniform spheres. The cell walls are closed without any opening enabling the cells to retain a fluid, typically air, in them. As the cells are compressed, the fluid pressure in the cells increases, and this increases the cell's resistance against a compression caused by an impact force. In other words, as the impact force increases, the cells become less effective as a cushioning layer and transfers more energy to the helmet wearer's skull. In addition, excessive compression pressure on the cells of closed cell foam can stretch the cell walls beyond their elastic limit, the cells can become permanently distorted, develop compression set and even rupture, with either scenario requiring the foam to be replaced.

In a preferred embodiment, cushion layer 2 may be constructed of an open cell foam, which has openings in the cell walls. When an open cell foam is compressed, the air exits the cells and the air pressure in the cells remains essentially the same. This means that as the cells are compressed, their resistance against the compression force remains about the same and does not increase like a closed cell foam. Thus, the effectiveness of open cell foam as a cushion layer 2 material remains the same regardless of the amount the foam is compressed.

In a preferred embodiment, cushion layer 2 may be a flexible foam. ASTM D3574 should be used to quantify Indentation force deflection/indentation load deflection (IFD/ILD) of a foam to determine its acceptability as a cushioning material to determine its acceptability, not a foam's density. Preferably, cushion layer 2 may be a flexible polyurethane open cell foam with a. Examples of open cell foams, but not limited to, may be made of specially prepared crosslinked low-density polyethylene foam, or crosslinked EVA copolymer, or flexible polyurethane foam prepared by the reaction of a diisocyanates or polyisocyanates with a polyol in the presence of a blowing agent, a surfactant, and a catalyst with or without external heating during its foaming. ASTM D3574 should be used to quantify Indentation force deflection/indentation load deflection (IFD/ILD) of a foam to determine its acceptability, not a foam's density.

DETAILED DESCRIPTION OF THE INVENTION

Figure 1:
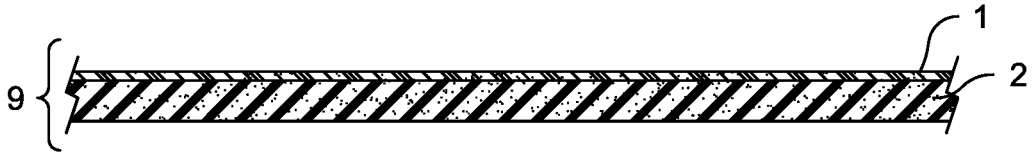
FIG. 1 shows a partial cross-sectional view of a single helmet shell taken at line I in FIG. 23.

The aspects of the Protective Helmet 21 are suitable for contact, semi-contact, limited-contact or non-contact activities, and may be used by all individuals taking part in activities, but are not limited to football, lacrosse, ice hockey field hockey, rugby, soccer, mixed martial arts, basketball, squash, racquetball, water polo, handball, wrestling, and boxing. In addition, it can be worn by individuals that have balance and medical problems that make them susceptible to falling.

Unlike current helmets, the design of the protective helmet 21 disclosed in this patent application has a flexible outer structure referred to as the helmet shell 9 so when struck with an impact force, the helmet shell 9 flexes and spreads the energy of the impact force over a larger area to reduce the pounds per square inch of the force to dissipate and mitigate the energy to the wearer's head to reduce the adverse effect of an impact force. According to one aspect, the protective helmet 21, has a flexible layer helmet shell 9 comprised of a slightly foamed layer 1 having a Flexural Modulus ranging from 50 MPa to 600 Mpa as measured using ASTM D 790 B.

According to one aspect of the invention, a Protective Helmet 21 includes an external head-protecting helmet shell 9 comprising a thermoplastic polymer that may or may not be crosslinked or a vulcanized polymer and these materials having a non-foam specific gravity of 916 kg/m$^3$ up to 1600 kg/m$^3$ ASTM D 792 with an initial Flexural Modulus above 600 Mpa as measured using ASTM D 790 B. However, the materials may be foamed to reduce its flexural modulus below 600 Mpa and to reduce it specific gravity. Foaming also reduces material cost and weight of the protective helmet 21 and make it more comfortable to the wearer. Foaming also reduces the cycle time of making the helmet shell 9 if the material is injection molded. For some materials, the shell may be below 600 Mpa in a non-foamed state, and the non-foamed material of the shell has a Flexural Modulus from 50 Mpa to 600 Mpa as measured using ASTM D 790 B. The art of extruding thermoplastics foams is well known and is described in the following U.S. patents by Knaus: U.S. Pat. No. 4,308,352 Process of Extruding Polysulfone Foam, U.S. Pat. No. 4,836,814 Multicolored foam and method for making, U.S. Pat. No. 5,589,519 Process of extruding lightly crosslinked polyolefin foam, U.S. Pat. No. 5,750,584 Stability control agent composition for polyolefin foam, or U.S. Pat. No. 5,605,937 Moldable thermoplastic polymer foam bead.

Foaming a plastic has several advantages. It reduces the amount of plastic needed to produce the same volume required for a product. For example, if 1.0 pound (lbs.) of plastic is used to make a product, and the plastic is foamed to a specific gravity that is 20% lower than the non-foamed plastic specific gravity, then 20% less plastic is needed to make the same product. Thus, the cost of the product is reduced by about 20%, resulting in a substantial savings of the plastic costs. Also, the volume of material produced is increased by 20%. In addition, a foamed plastic shell is lighter in weight making it more comfortable for the wearer. If an injection molding process is used to make a shell, foaming the plastic reduces its viscosity, which makes it easier for the plastic to flow into the mold and fill the mold quicker. Thus, the molding cycle time is reduced for a foamed plastic versus the same non-foamed plastic. Foaming a plastic can also reduce its Flexural Modulus. These benefits exist for essentially all thermoplastics that can be foamed.

The helmet shell 9 can be made as a single piece or multiple pieces to form a single contiguous helmet shell 9 layer. The protective helmet 21 further includes an inner cushion layer 2, typically foam, which may or may not be attached to the helmet shell 9 and has a IFD/ILD of 20 pounds to 200 lbs. and preferably 60 lbs. to 70 lbs. Preferably, the cushion layer 2 thickness can range from 0.060 inches (in.) to 1.25 inches (in.). The waterproof coating layer 3 in this patent application can be a thermoplastic film or coating adhered to the cushion layer 2. One purpose of the waterproof coating layer 3, but not the only one, is to make it water or moisture resistant and easy to clean and prevent contamination of the internal surfaces of the cushion layer 2. All components of the protective helmet 21 can contain additives such as color, an antibacterial or antifungal compound and/or a scent compound.

The helmet shell 9 may be made of a one piece in some embodiments. For example, material may be made into a single piece to form the helmet shell 9, and components may be attached to the protective helmet 21 or helmet shell 9. Components such as connectors may be included on the protective helmet 21 or helmet shell 9 would still be considered one piece. In another embodiment, the helmet shell 9 may be made of more than one piece.

Cushion layer 2 may be a foamed polymer such as flexible polyurethane foam. One method to make a flexible polyurethane foam is by the reaction of diisocyanates or polyisocyanates, with a polyol in the presence of a blowing agent, a surfactant, and a catalyst with or without external heating during its foaming. Cushion layer 2 may be comprised of a polystyrene, polypropylene, polyethylene, thermoplastic polyurethane (TPU), thermoplastic elastomers (TPE), Silicone polymer, EPDM polymers, Natural Rubber, Neoprene, or other suitable thermoplastics that can be crosslinked, or non-crosslinked, and foamed with a chemical or physical blowing agent.

According to another aspect of this patent application, a protective helmet 21, may include an external head-protecting helmet shell 9 with an inner cushion layer 2 and a second helmet shell 9 and a second inner cushion layer 2. The helmet shell 9 may be made of a flexible thermoplastic polymer that may or may not be crosslinked or a vulcanized polymer and these materials or a combination thereof, having a non-foamed specific gravity 0.916 g/cm$^3$ up to 1.60 g/cm$^3$ or a density of 916 kg/m$^3$ up to 1600 kg/m$^3$ with a Flexural Modulus ranging from 50 Mpa to 600 Mpa as measured using ASTM D 790 B. The external helmet shell 9 and second internal helmet shell 9, can be comprised of a single piece or multiple pieces that form a single contiguous helmet shell 9 layer for either helmet shell 9. The external helmet shell 9 and second helmet shell 9 can be made of a non-foamed or foamed materials, for example, thermoplastic elastomers or a polyester elastomer such as Dupont Hytrel® 4556 (94 Mpa) and Hytrel® 5526 (207 Mpa).

According to another aspect, a protective helmet 21 may include an external head-protecting helmet shell 9 that covers, at least partially, a wearer's head. The protective helmet 21 can also include a portion to protect the wearer's face and eyes by covering it in part or whole with a protective barrier 8 attached to the helmet shell 9. The protective barrier may be made of bars of steel rods crisscrossing in a configuration referred to as a "facemask" to prevent the entry of a ball, puck, stick, a hand/finger, or other objects that could injure the helmet wearer. Protective barrier 8 may also be constructed of a clear thermoplastic polymer such as polycarbonate or polysulfone, to name a few. The protective barrier 8 can be made up of a combination of a facemask and a clear thermoplastic polymer shield. In some embodiments, the protective helmet 21 includes a chin strap to enable improved adjustment and fit and to secure the protective helmet 21 to the wearer's head.

In another aspect of this patent application, since heads vary in size and shape, additional cushion layer pads 32 may be provided as fillers to improve the helmet shell 9 fit. The cushion layer pads 32 can be provided with an adhesive surface or Velcro adhere to the surfaces that need the cushion layer pads 32. The cushion layer pads 32 can be interchanged and positioned by the wearer to achieve the best fit and comfort. While Velcro is described as an attachment mechanism, other methods such as adhesives or magnets or magnetic materials, can be used.

Figure 23:
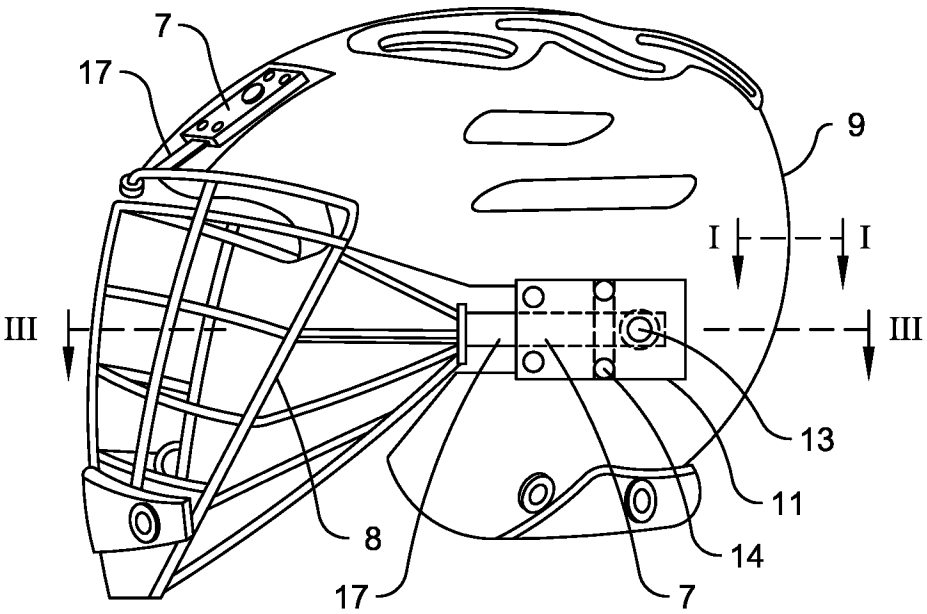
FIG. 23 shows a left side elevational view of a protective helmet.
Figure 22:
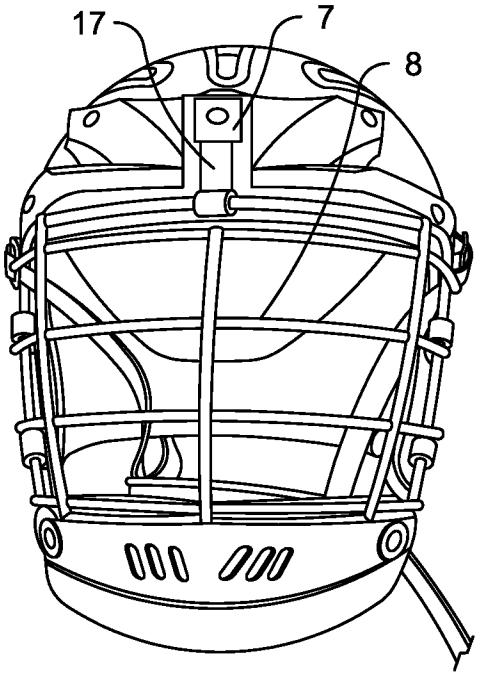
FIG. 22 shows a front side elevational view of a protective helmet.

As shown in FIG. 1 and FIGS. 22 and 23, protective helmet 21 may be comprised of an external helmet shell 9 which may be comprised of a slightly foamed layer 1 and a cushion layer 2 that provides protection to the wearer's head in some embodiments. Each helmet shell 9 should be configured to enclose the head of a wearer, each helmet shell having an external side facing away from the head and an internal side facing toward the head of the wearer. Slightly foamed layer 1 may be constructed of a thermoplastic polymer that may or may not be crosslinked or a vulcanized polymer and had a flexural modulus above 600 Mpa before it was slightly foamed and after it is slightly foamed has a flexural modulus ranging from 50 Mpa to 600 Mpa. FIG. 1 shows a partial cross-section of a single helmet shell 9 taken at line I in FIG. 23 with slightly foamed layer 1 material and a cushion layer 2 depicted. Helmet shell 9 has a reduced specific gravity achieved by foaming it and has a Flexural Modulus ranging from 50 Mpa to 600 Mpa as measured using ASTM D 790 B. It should be appreciated that aesthetic additions to the protective helmet 21 which do not provide protection to the wearer's head, such as paint, decals, or stickers, may be applied to the outer surface of the protective helmet 21, and the external helmet shell 9 still be considered the outermost layer of the helmet.

In some embodiments, the cushioning material of the external helmet shell 9 has a IFD/ILD of 60 lbs. to 70 lbs and with the helmet shell 9 having a flexural modulus ranging from 50 Mpa to 600 Mpa as measured using ASTM D 790 B. In some embodiments, the external helmet shell 9 is made of a thermoplastic polymer having a specific gravity less than its non-foamed state. The thermoplastic polymer may be thermoplastic elastomer (TPE), thermoplastic polyurethane (TPU), or any other suitable thermoplastic polymer. The specific gravity of the foamed thermoplastic polymer may be 10% to 99% of the non-foamed counterpart. For example, if the non-foamed polymer has a specific gravity of 1.0, then the foamed polymer may have a specific gravity in the range of 0.10 to 0.99. The external helmet shell 9 may have a thickness range of 0.050 inches to 1.25 inches, or any other suitable thickness based on the application and intended use.

As seen in FIG. 1 through FIG. 11, each layer of the helmet shell 9 may be attached to each other by any suitable arrangement, such as glue, hot melt glue, Velcro or any suitable method well known in the art. As used herein, the term "attached" includes, but is not limited to, arrangements in which items are directly attached to one another. Additionally, a first item can be considered to be attached to a second item by being attached to the second item via an intermediate component or components. Different types of cushion layer 2 may be attached to the inside of the helmet shell 9. In all embodiments, the cushion layer 2 may be more flexible than the external head-protecting shell.

The cushion layer 2 may have a thickness of 0.032 inches to 1.25 inches. In some embodiments, the cushion layer 2 may have a thickness range from 0.05 inches to 0.500 inches. In most embodiments the thickness of the cushion layer 2 will be maximized in most or all areas of the helmet shell 9 to provide the helmet wearer with the maximum protection against the effects of the energy from an impact force.

In all embodiments, the cushion layer 2 is made of a foam, such as foamed thermoplastic polymer with or without ethylene vinyl acetate copolymer as a softener, that can be crosslinked, non-crosslinked, or a flexible polyurethane foam prepared by the reaction of a diisocyanates or polyisocyanates with a polyol in the presence of a blowing agent, a surfactant, and a catalyst with or without external heating during its foaming, or a polyurethane thermoplastic made with a chemical or physical blowing agent or a vulcanized polymer that is foamed. The foam may be compression molded, die cut, or processed by any other suitable method.

In some embodiments, the helmet shell 9 includes areas of a cushion layer 2 that is thinner. In some embodiments, a secondary cushion layer 2 may be thinner. In one embodiment, the secondary cushion layer 2 thickness is at least the same as the first cushion layer 2 or thicker.

Figure 2:
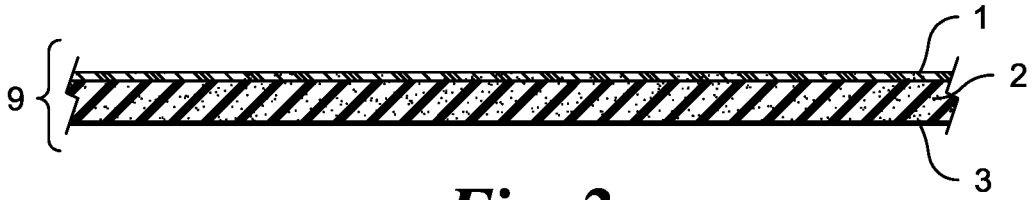
FIG. 2 shows a partial cross-sectional view of a helmet shell taken at line I of FIG. 23.

In another embodiment, FIG. 2, shows a partial cross-section of helmet shell 9, taken at line I of FIG. 23, comprised of a slightly foamed layer 1, made from a thermoplastic polymer that may or may not be crosslinked or a vulcanized polymer and had a Flexural Modulus above 600 MPa before it was slightly foamed and after it is slightly foamed has a Flexural Modulus ranging from 50 MPa to 600 MPa. The cushion layer 2 can be made from a foamed thermoplastic polymer that can be crosslinked, or non-crosslinked, or a polyurethane thermoplastic or a vulcanized polymer. The foamed polymers are foamed using a chemical or physical blowing agent. Another foam can be flexible polyurethane foam made by the reaction of diisocyanates or polyisocyanates with a polyol in the presence of a blowing agent, a surfactant, and a catalyst with or without external heating during its foaming. The thickness range of the cushion layer 2 can be from 0.032 inches to 1.250 inches with a IFD/ILD of 20 pounds to 200 lbs. and preferably 60 lbs. to 70 lbs. The foam of the cushion layer 2 can be closed or open cell, but preferably the cushion layer 2 foam is made of an open cell foam. A waterproof coating layer 3 may be comprised of a film or liquid coating with a water or solvent carrier that evaporates, and the coating becomes a water or moisture proof layer that is also resistant to other fluids.

Figure 3:
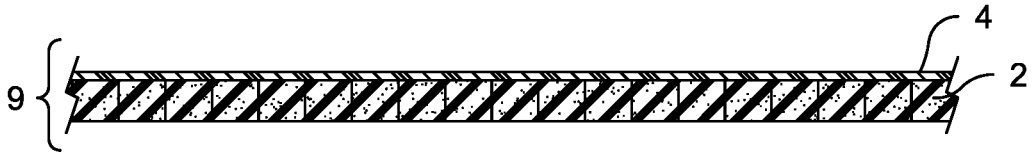
FIG. 3 shows a partial cross-sectional view taken at line I in FIG. 23 of an alternate embodiment of a helmet shell.

In another embodiment, FIG. 3 shows a partial cross section, taken at line I in FIG. 23, of a helmet shell 9 with a flexible layer 4, made from a thermoplastic polymer that may or may not be crosslinked or a vulcanized polymer with a Flexural Modulus ranging from 50 MPa to 600 MPa. Flexible layer 4, can be non-foamed or slightly foamed. Cushion layer 2 has previously been described with respect to FIG. 1 and FIG. 2.

Figure 3A:
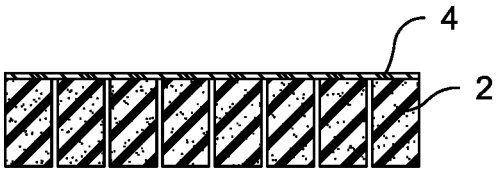
FIG. 3A shows a side elevational view of an embodiment of a helmet shell with elongated square or rectangular cushion layer segments.
Figure 3C:
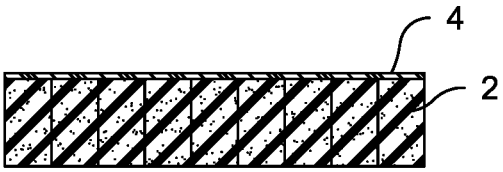
FIG. 3C shows a side elevational view of an embodiment of a helmet shell with elongated cylindrical cushion layer segments.
Figure 3B:
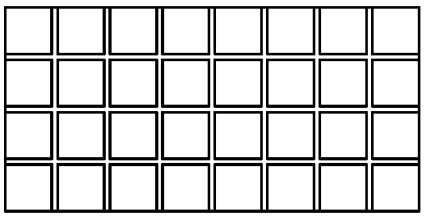
FIG. 3B shows a bottom plan view of an embodiment of a helmet shell with elongated square or rectangular cushion layer segments.
Figure 3D:
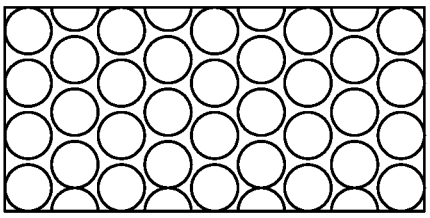
FIG. 3D shows a bottom plan view of an embodiment of a helmet shell with elongated cylindrical cushion layer segments.

FIGS. 3A through 3B show alternate embodiments of cushion layer 2. Cushion layer 2 may be a continuous layer or it can be comprised of multiple shapes such as an elongated square or cylinder. These cushion layer components may be spaced to enable the foam to compress and absorb the torsional rotational forces of the wearer's head in addition to the impact forces. As shown in FIGS. 3A and 3B, cushion layer 2 may be comprised of square or rectangular segments affixed to flexible layer 4. As shown in FIGS. 3C and 3D, cushion layer 2 may be comprised of cylindrical segments affixed to flexible layer 4.

The purpose of spacing between the foam shapes is to enable the head to rotate yet still have the foam absorb the rotational torsion forces as well as the impact forces. A concussion can be caused by stretching and tearing of the neurons and Axons. Axons are electrical pathways that connect neurons. The Axons can tear and lead to the death of neurons and Axons adjacent to the neurons and Axons that were originally damaged. By enabling the head to rotate, and decelerate it with cushioning foam, it will mitigate or at lease reduce the trauma from the rotational torsion forces that could tear the neurons and Axons.

Figure 4:
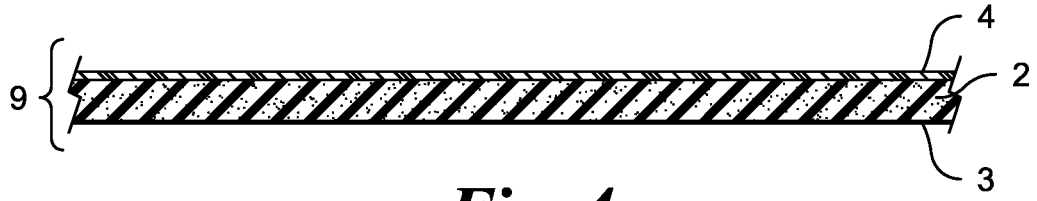
FIG. 4 shows a partial cross-sectional view taken at line I in FIG. 23 of an alternate embodiment of a helmet shell.

In another embodiment, FIG. 4 shows a partial cross section, taken at line I in FIG. 23, of a helmet shell 9 comprised of a flexible layer 4 with a flexural modulus ranging from 50 MPa to 600 MPa, a cushion layer 2 and a waterproof coating layer 3.

In another embodiment, a first cushion layer 2 and a second cushion layer 2 may be made of one or more layers. In an arrangement with more than one cushion layer 2, each layer may or may not be made of a different material. In some embodiments, the cushion layer 2 attached to the external helmet shell 9 may have a higher specific gravity making it less flexible than that of the layer of the cushion layer 2 furthest from the external helmet shell 9. It should be appreciated that more or fewer cushion layers 2 may be used. In some embodiments, some or all cushion layer 2 may be made of the same material. In some embodiments, a cushion layer 2 may have a different thickness and/or specific gravity.

Figure 5:
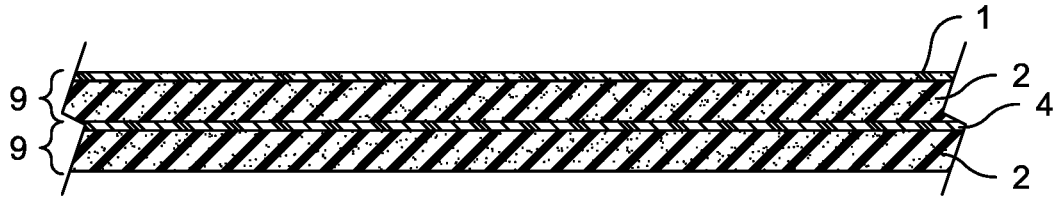
FIG. 5 shows a partial cross-sectional view taken at line I in FIG. 23 of an alternate embodiment of a helmet shell.

FIG. 5 shows a partial cross section, taken at line I in FIG. 23, of an external helmet shell 9 comprised of a slightly foamed layer 1, with a flexural modulus ranging from 50 MPa to 600 MPa, a cushion layer 2, a second helmet shell 9 layer made from a non-foamed flexible layer 4 that has a flexural modulus ranging from 50 MPa to 600 MPa, and a second cushion layer 2. Where more than one helmet shell is used, the helmet shells should be stacked with respect to each other. Each of the helmet shells has an external side facing away from the head of the wearer and an internal side facing toward the head of the wearer. Being stacked, the external side of an inner helmet shell (i.e. a helmet shell closer to the wearer's head) will be in contact with the internal side of an outer helmet shell (i.e. one further from the wearer's head).

Figure 6:
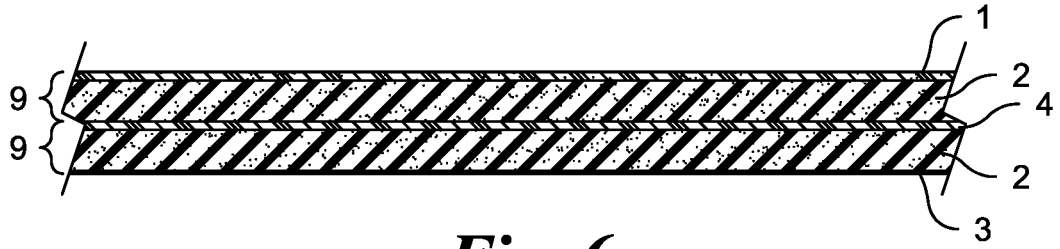
FIG. 6 shows a partial cross-sectional view taken at line I in FIG. 23 of an alternate embodiment of a of an external helmet shell.

FIG. 6 shows a partial cross section, taken at line I in FIG. 23, of a helmet shell 9 comprised of a slightly foamed layer 1 having a flexural modulus ranging from 50 MPa to 600 MPa, a cushion layer 2, and a second helmet shell 9 layer made from a non-foamed flexible layer 4 having a flexural modulus ranging from 50 MPa to 600 MPa, a second cushion layer 2, and an waterproof coating layer 3.

Figure 7:
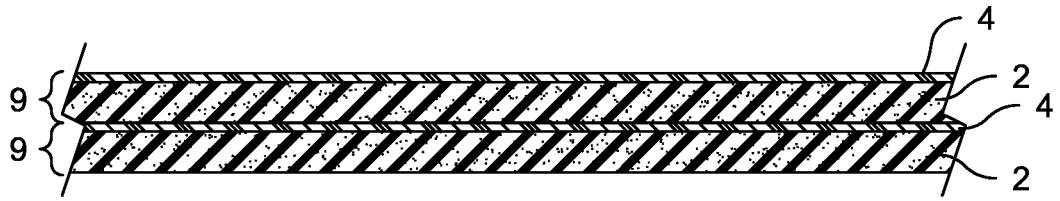
FIG. 7 shows a partial cross-sectional view taken at line I in FIG. 23 of an alternate embodiment of an external helmet shell.

FIG. 7 shows a partial cross section, taken at line I in FIG. 23, of a helmet shell 9 with a non-foamed flexible layer 4, a foam cushion layer 2, a second helmet shell 9 layer made from non-foamed flexible layer 4, and a second foam cushion layer 2.

Figure 8:
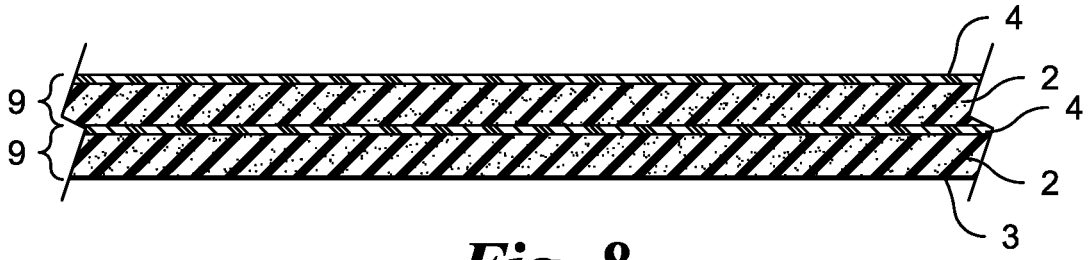
FIG. 8 shows a partial cross-sectional view taken at line I in FIG. 23 of an alternate embodiment of an external helmet shell.

FIG. 8 shows a partial cross section, taken at line I in FIG. 23, of a helmet shell 9 with a non-foamed flexible layer 4, a foam cushion layer 2, a second helmet shell 9 layer made from non-foamed flexible layer 4, a second foam cushion layer 2 and a waterproof coating layer 3.

Figure 9:
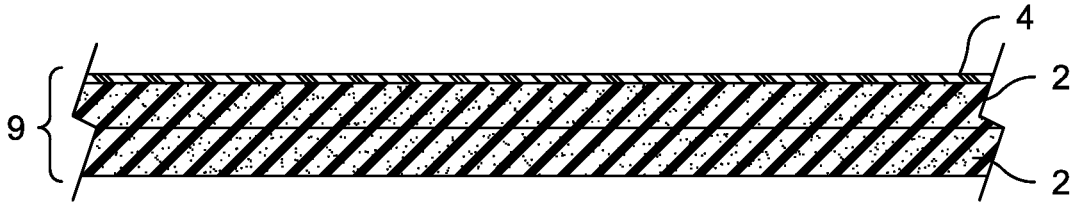
FIG. 9 shows a partial cross-sectional view taken at line I in FIG. 23 of an alternate embodiment of an external helmet shell.

FIG. 9 shows a partial cross section, taken at line I in FIG. 23, of a helmet shell 9 with a non-foamed flexible layer 4, having a flexural modulus ranging from 50 MPa to 600 MPa, a foam cushion layer 2, and a second foam cushion layer 2.

Figure 10:
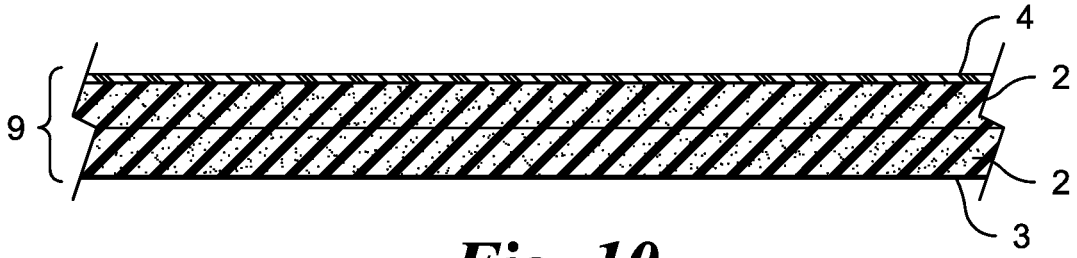
FIG. 10 shows a partial cross-sectional view taken at line I in FIG. 23 of an alternate embodiment of an external helmet shell.

FIG. 10 shows a partial cross section, taken at line I in FIG. 23, of a helmet shell 9 with a non-foamed flexible layer 4 having a flexural modulus ranging from 50 MPa to 600 MPa, a foam cushion layer 2, a second foam cushion layer 2 and an waterproof coating layer 3.

Another aspect of this patent application has a separator layer 5 containing air spaces or channels through the separator layer 5 to allow for increased air flow. The inside of a helmet shell 9 can become warm and since the cushion layer 2 is a foam and foams are an insulator, it can retain heat within the helmet shell 9. Creating air channels and openings in the helmet shell 9 cushion layer 2 and other layers allows for ventilation and helps mitigate some of this heat. The separator layer 5 can promote improved air flow between the cushion layer 2 and the wearer's head. Additional air circulation can be achieved with a device to force air flow such as a fan or a $CO_2$ cartridge with a flow control mechanism.

Figure 11:
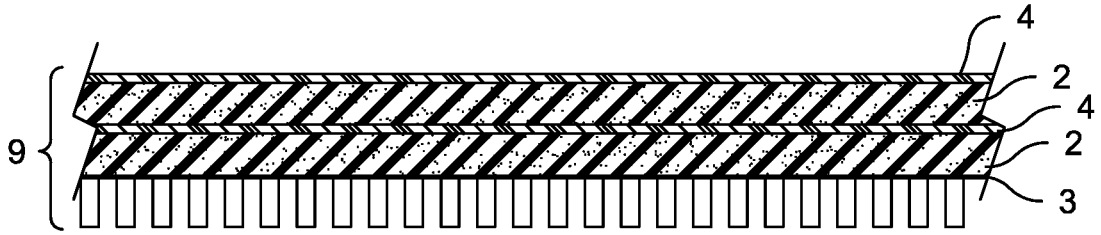
FIG. 11 shows a partial cross-sectional view taken at line I in FIG. 23 of an alternate embodiment of an external helmet shell.

FIG. 11 shows a helmet shell 9 with a non-foamed flexible layer 4 having a flexural modulus ranging from 50 MPa to 600 MPa, a foam cushion layer 2, an optional second non-foamed flexible layer 4 having a flexural modulus ranging from 50 MPa to 600 MPa, an optional second foam cushion layer 2, a waterproof coating layer 3, and a separator layer 5. The separator layer 5 can be combined with any of the depictions in the drawings shown in FIG. 1 through FIG. 17.

Figure 12:
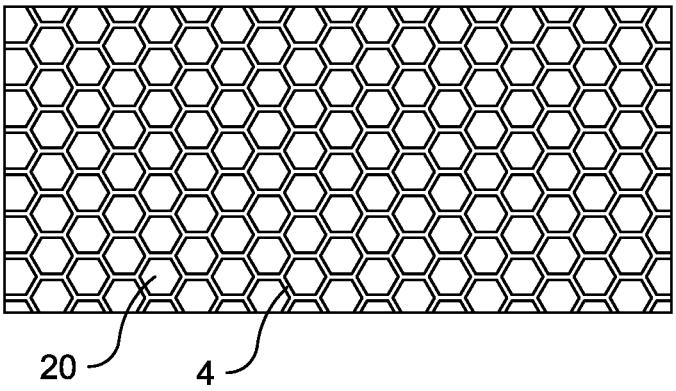
FIG. 12 shows a top plan view of a helmet shell with rigid particles.
Figure 13:
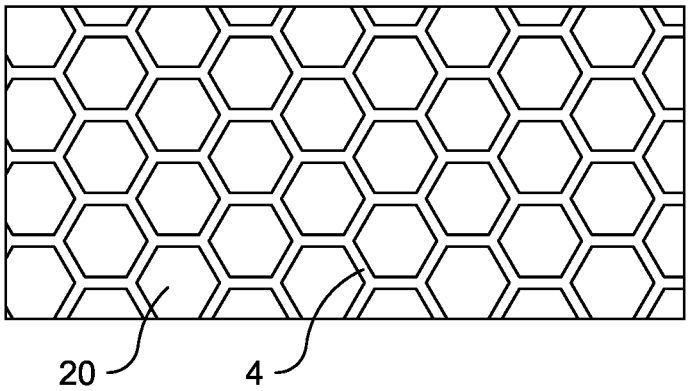
FIG. 13 shows a top plan view of an alternate embodiment of a helmet shell with rigid particles.

In another aspect of this patent application, the helmet shell 9 surface is made of a flexible layer having a flexural modulus ranging from 50 MPa to 600 MPa that is covered with multiple particles made of rigid particles 20 layer having a flexural modulus ranging above 600 MPa. The size of the rigid particles 20 layer on the helmet shell 9 can vary in size from 0.125" to 6" across. FIG. 12 and FIG. 13 shows a helmet shell 9 surface made of a non-foamed flexible layer 4. The rigid particles 20 can be multi sided having a hexagonal shape or without sides in the shape of a circle. The rigid particles may be adhered to the flexible layer such that rigid particles 20 are raised above the surface of the flexible layer. Further, the shape and size of the multiple rigid particles 20 layer material can be achieved by embossing them into helmet shell 9 or a flexible layer Helmet Shell 9. The rigid particles serve to provide a thicker surface for strength and durability, but still allowing flexibility as the rigid particles can move toward each other as the helmet shell compresses.

In FIG. 12, the rigid particles 20 covering the top of helmet shell 9 may have a hexagon shape. The hexagon shape can also be achieved by embossing them into rigid, slightly foamed shell, or a non-foamed flexible layer 4 of helmet shell 9. FIG. 13 shows rigid particles 20 in a larger hexagon shape.

In some embodiments, the combination of the internal cushion layer 2 with the flexible head-protecting helmet shell 9 allows the helmet shell 9 to provide the best impact protection. In all embodiments, the combination of the internal cushion layer 2 with the flexible layer helmet shell 9 allows the helmet shell 9 to maximize protection from the energy of an impact force. In all embodiments, the flexible layer helmet shell 9 absorbs and spreads the impact force over a larger area to reduce the force applied per square inch and in combination with the internal cushion layer 2 absorbs part or all of the energy from an impact force.

Figure 14:
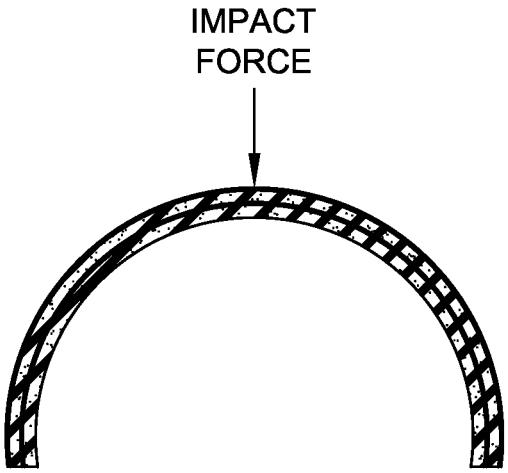
FIG. 14 shows a cross-sectional view taken at line II of FIG. 39 of a helmet shell when struck by and impact force.
Figure 15:
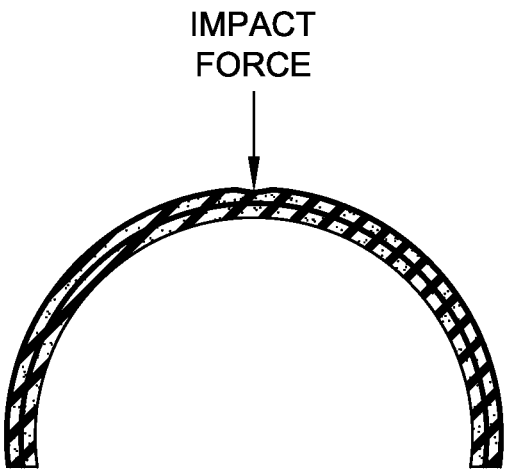
FIG. 15 shows a cross-sectional view taken at line II of FIG. 39 of a helmet shell when struck by an impact force.
Figure 16:
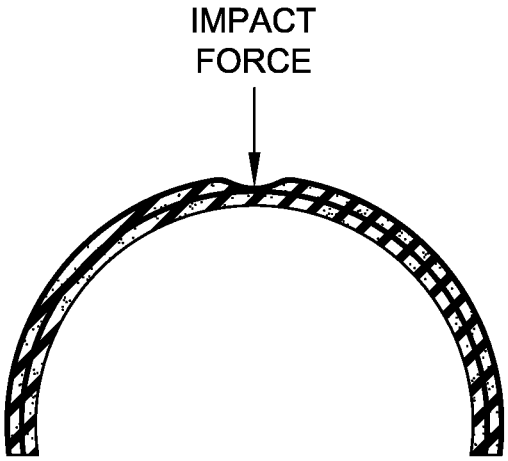
FIG. 16 shows a cross-sectional view taken at line II of FIG. 39 of a helmet shell when struck by an impact force.
Figure 17:
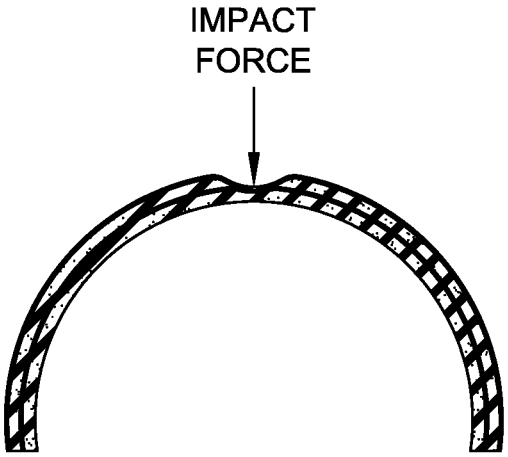
FIG. 17 shows a cross-sectional view taken at line II of FIG. 39 of a helmet shell when struck by an impact force.
Figure 19:
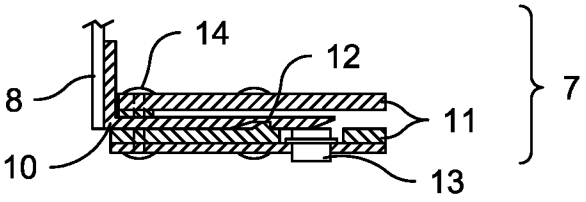
FIG. 19 shows a side elevational view of a locking mechanism with protective barrier attached.
Figure 21:
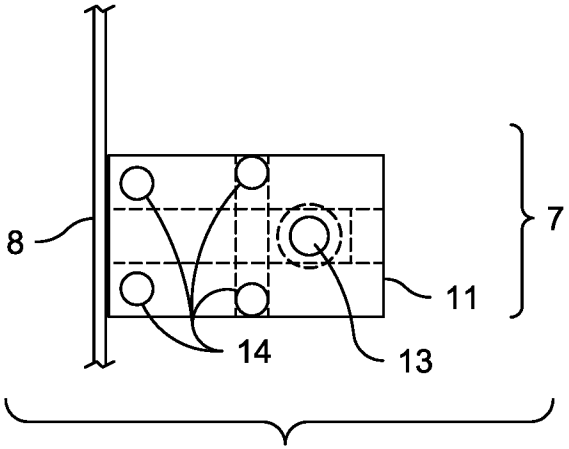
FIG. 21 shows a top plan view of a locking mechanism with protective barrier attached.
Figure 18:
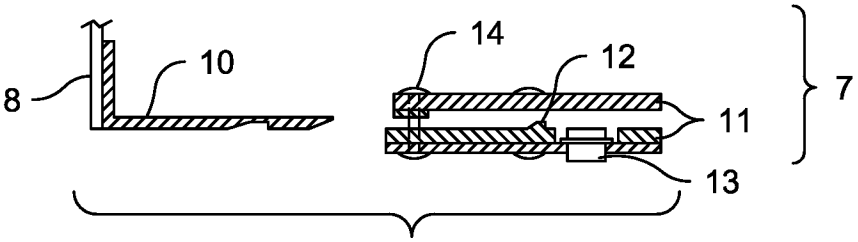
FIG. 18 shows a side elevational view of a locking mechanism with protective barrier detached.
Figure 20:
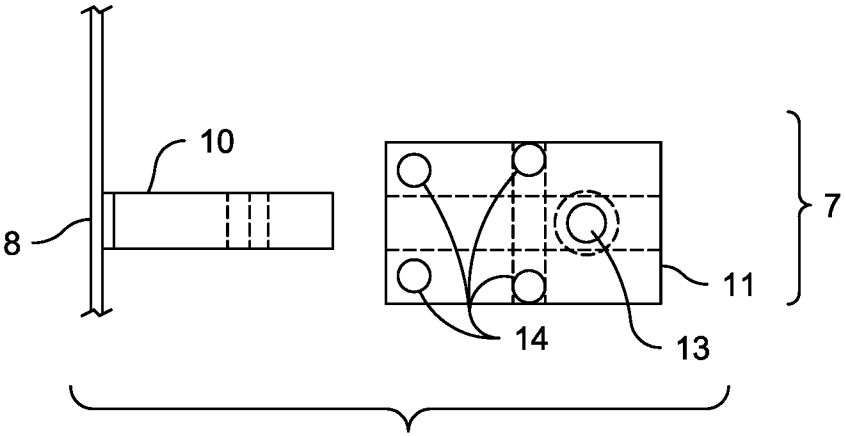
FIG. 20 shows a top plan view of a locking mechanism with protective barrier detached.
Figure 39:
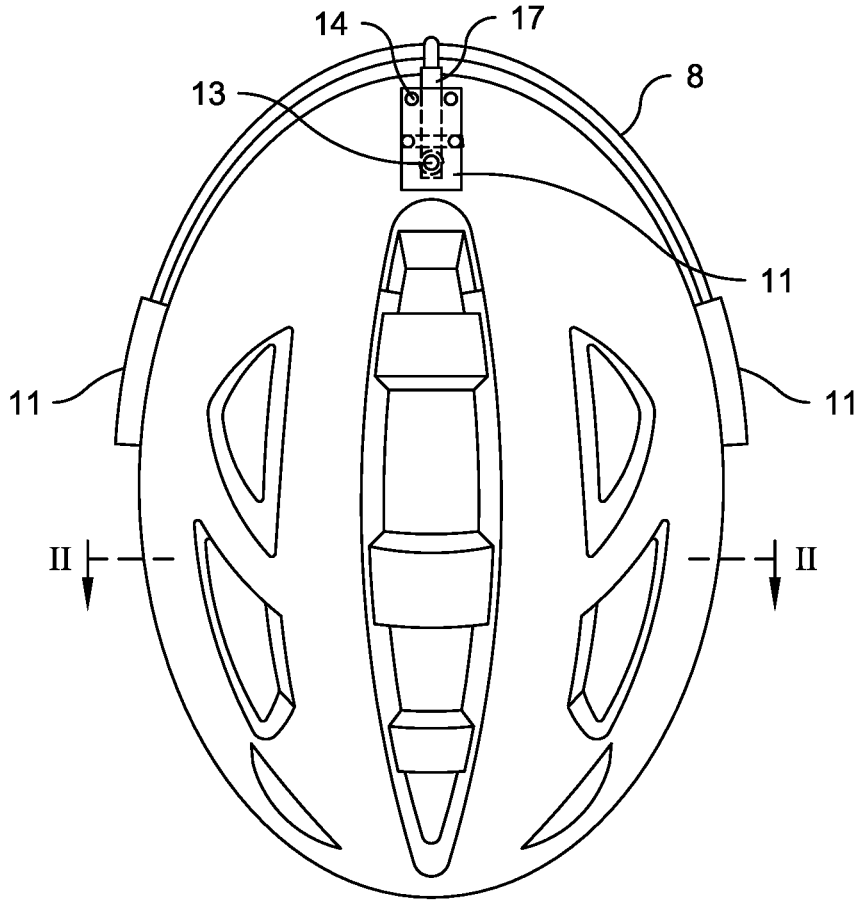
FIG. 39 shows a top plan view of a protective helmet.

FIGS. 14-17 shows cross sectional views of a protective helmet 21 taken at line II in FIG. 39 using the material layers depicted in FIG. 7 which shows a helmet shell 9 with a non-foamed flexible layer 4, a foam cushion layer 2, a second non-foamed flexible layer 4, and a second foam cushion layer 2. The graphics in FIG. 14 through FIG. 17 demonstrate the technology of this patent application. In FIG. 14, an impact force is contacting the external helmet shell 9. In FIG. 15, the impact force flexes the external helmet shell 9 downward. This spreads the impact force over a larger area, which reduces the pounds per square inch (psi) of the force. As the impact force compresses and flexes the external helmet shell 9, the first cushion layer 2 compresses and absorbs the energy from the impact force. Some or all of the energy is dissipated and mitigated; thus, the protective helmet 21 design reduces the potential injury to the protective helmet 21 wearer. FIG. 16 and FIG. 17 show the effect of a larger impact force that compresses and flexes the second flexible layer 4 downward, compressing the second cushion layer 2. When the second flexible layer 4 and the second cushion layer 2 have compressed, most if not all of the energy from the larger impact force has been dissipated and mitigated, causing little if any effect to the brain of the protective helmet 21 wearer.

Protective helmet 21 may be fitted with a protective barrier 8, intended to protect the protective helmet 21 wearer's facial area and eyes. Some helmets may be fitted with a facial barrier intended to protect the wearer's facial area and eyes. Many of the current barriers are made of bars of steel rods crisscrossing in a configuration referred to as a "facemask" to prevent the entry of a ball, puck, stick, a hand, or other foreign objects that could injure the helmet wearer. Often, this barrier is bolted on the front top of the helmet and bolted at a spot on each side using a clip that surrounds the steel rod and has an opening for a bolt. If the side bolts are removed, the barrier can be pivoted and rotated off the wearer's face. This also enables easier removal of the helmet. If the wearer of the helmet suffers a head, facial, or neck injury, the person treating the injury may want to remove the helmet. Typically, removing the side bolts or screws enables the pivoting of the barrier off the wearer's face for easier removal of the barrier. However, removing the bolts requires a screwdriver, which may or may not be available. In addition, even if a screwdriver is available, it takes time and time may be of essence.

By contrast, the invention provides for a locking mechanism 7 which permits easy removal of the protective barrier 8. FIG. 18 through FIG. 21 and FIGS. 22, 23, 39 and 40 show a locking mechanism 7, to secure the protective barrier 8, to the protective helmet 21. The protective helmet 21 of the invention provides for a protective barrier 8 which may be easily removed to permit above the wearer's face to permit the wearer to see, drink and interact more easily and which permits easier removal of protective helmet 21.

Components of the locking mechanism 7 include latch 10, fixture assembly 11, hook 12, button 13, and rivet 14. One end of latch 10 may be inserted into fixture assembly 11 and configured to engage hook 12 which moves in conjunction with button 13. When the button 13 is depressed, it should push latch 10 away from the hook 12 to release latch 10 from the locking mechanism 7. The other end of latch 7 may be secured to protective barrier 8. By pushing the button 13, in seconds, the protective barrier 8 is released and removed to access the wearer's face and/or remove the protective helmet 21.

The latch 10 can be interchanged or replaced with extended flexible component 17. Extended flexible component 17 may be designed to be flexible to allow movement of protective barrier 8 relative to helmet shell 9. In a similar manner, if extended flexible component 17 is utilized, on end of extended flexible component should fit into fixture assembly 11, the end being configured, similar to the latch, to engage hook 12 and button 13. When the button 13 is depressed, it should push extended flexible component 17 away from the hook 12 to release extended flexible component 17 from the locking mechanism 7. Extended flexible component 17 may also be connected at its other end to protective barrier 8. FIG. 18 through FIG. 21 show one variation of the embodiment of the locking mechanism 7.

FIG. 22, FIG. 23, FIG. 39 and FIG. 40 show a protective helmet 21 with a locking mechanism 7, located on each side of the helmet and in the center front of the helmet to secure the protective barrier 8, to the helmet shell 9. Some protective helmets 21 are fitted with a protective barrier 8, intended to protect the helmet wearer's eyes, mouth and other facial features. The locking mechanism 7 has an extended flexible component 17 that holds the protective barrier. The extended flexible component 17 attaches the protective barrier 8 to the helmet shell 9 and may be inserted into fixture assembly 11 to engage the hook 12. When an impact force strikes the helmet, the extended flexible component 17 enables the helmet shell 9 to flex inward to absorb and mitigate the energy from an impact force while still permitting the protective barrier to remain in a position in front of the wearer's face. The extended flexible component 17 can be made of spring steel or any suitable material that is flexible and has sufficient the strength not to fail.

When the button 13, of the locking mechanism 7, is suppressed or pushed in, the protective barrier 8 can be released from the protective helmet 21 and can be easily pivoted and rotated off the wearer's face or be completely removed. If the wearer of the protective helmet 21 suffers a head, facial, or neck injury, the person treating the protective helmet 21 wearer's injury will want to remove the protective barrier 8 and protective helmet 21. In seconds, the protective barrier 8, can be released and can be removed by pushing in button 13. This also enables easy removal of the protective helmet 21. FIG. 22, FIG. 23, FIG. 39, and FIG. 40 show an embodiment of the protective helmet 21 with the locking mechanism 7.

Figure 25:
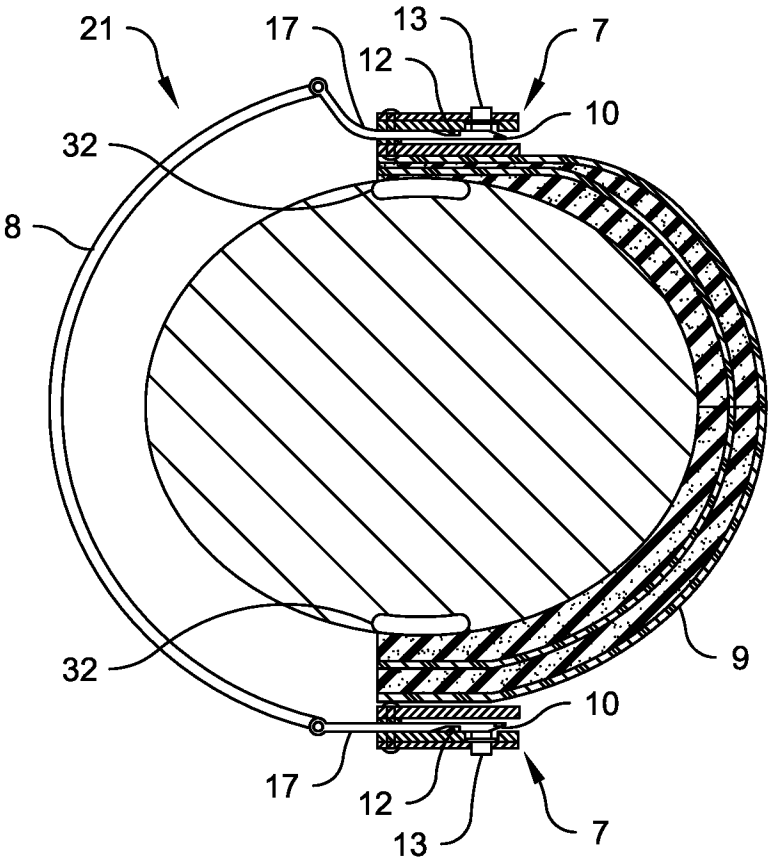
FIG. 25 shows a cross sectional view taken at line III of FIG. 23 of a helmet shell after being struck by an impact force.
Figure 24:
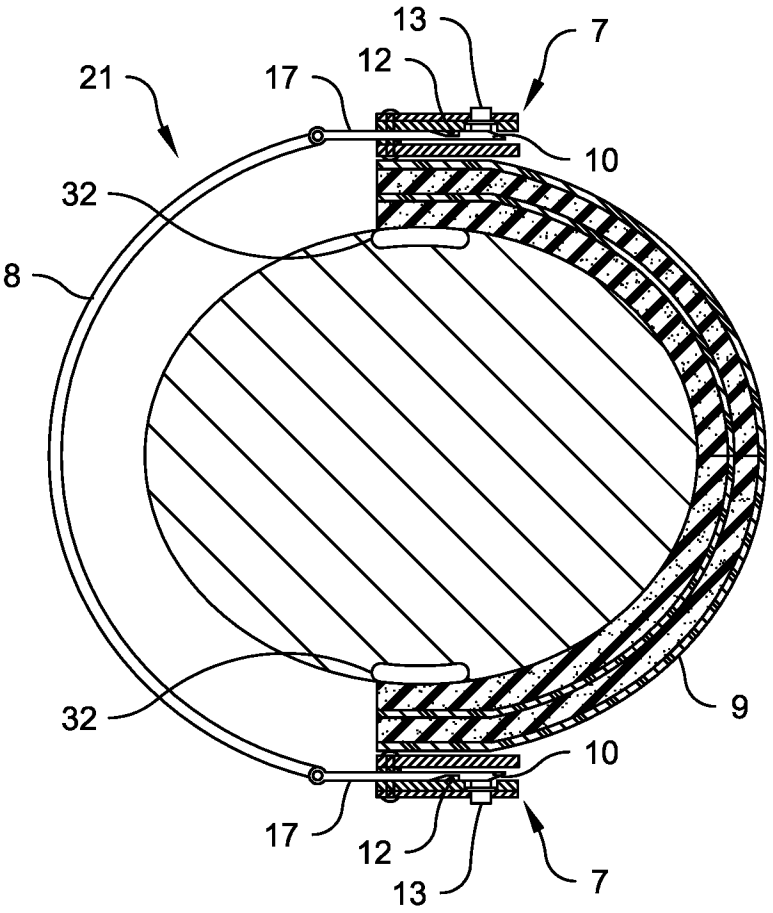
FIG. 24 shows a cross sectional view taken at line III of FIG. 23 of a helmet shell before being struck by an impact force.

FIG. 24 and FIG. 25 show a cross section of a helmet, taken at line III in FIG. 23 of a protective helmet 21 with a locking mechanism 7, located on each side of the helmet. Not shown is the locking mechanism 7, on the center front of the helmet. The locking mechanism 7, secures the protective barrier 8, to the helmet shell 9. Some protective helmets 21 are fitted with a protective barrier 8, intended to protect the helmet wearer's facial area and eyes. The protective barrier 8, may be constructed of bars of steel rods crisscrossing in a configuration referred to as a "facemask" to prevent the entry of a ball, stick, a hand, or other foreign objects that could injure the helmet wearer. A clear plastic protective barrier 8 can also be used. The latch 10 of locking mechanism 7 has an extended flexible component 17 that holds the protective barrier 8. The extended flexible component 17 attaches the protective barrier 8 to the protective helmet 21. When the protective helmet 21 wearer experiences an impact force strike to the side of the protective helmet 21 as shown in FIG. 25, the extended flexible component 17 enables the helmet shell 9 to flex inward to absorb and mitigate the energy from an impact force on the side of the helmet, and the flexing of the helmet reduces the rate of deceleration, distributes the energy of an impact force over a larger area of the protective helmet 21 to reduce the energy intensity per square inch area, and absorbs and mitigates the energy of an impact force. If the helmet shell 9 cannot flex from an impact force, the helmet shell 9 could transfer the energy from an impact force like a Newton's Cradle to the skull of the wearer of protective helmet 21 that could cause a brain injury. The extended flexible component 17 can be made of spring steel or any suitable material that is flexible and has sufficient strength not to fail. FIG. 24 and FIG. 25 shows one variation of the embodiment of the protective helmet 21 with the locking mechanism 7.

Figure 27:
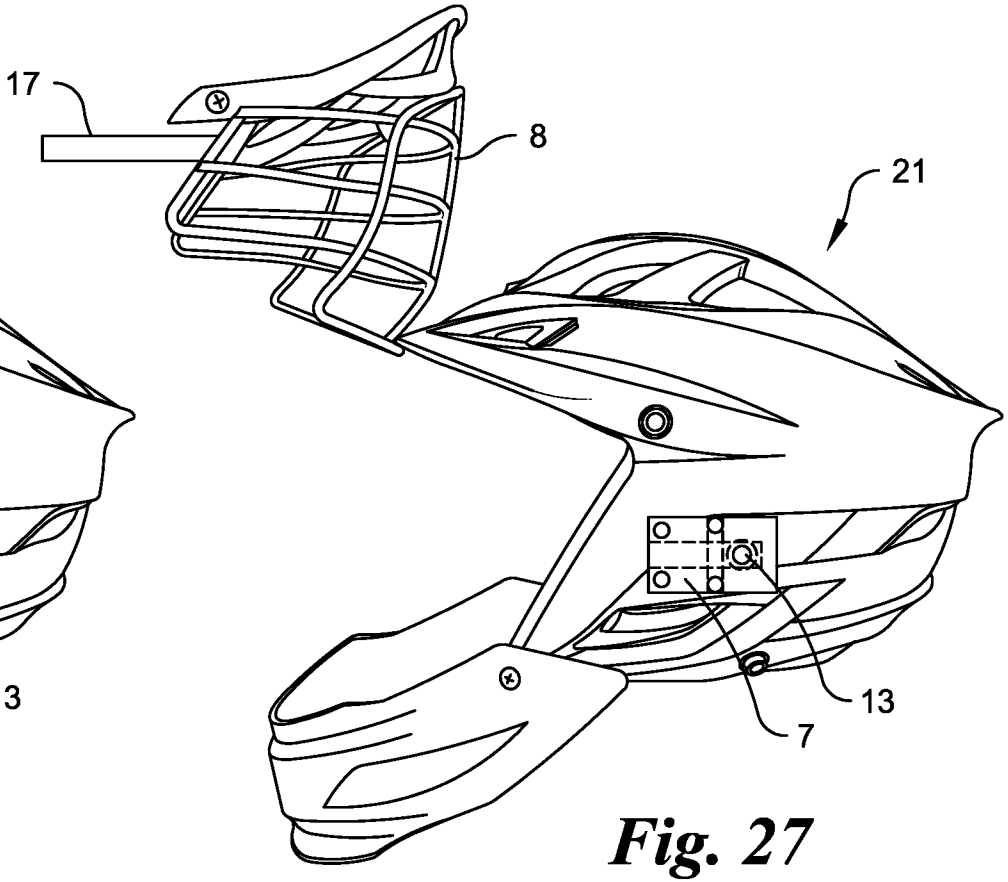
FIG. 27 shows a side elevational view of a protective helmet with protective barrier rotated upwards.
Figure 26:
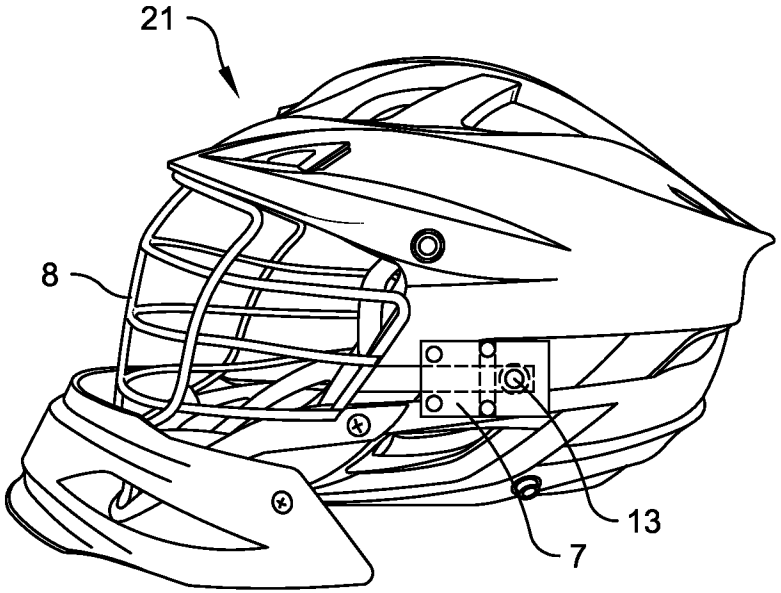
FIG. 26 shows a side elevational view of a protective helmet with protective barrier positioned in front of wearer's face.

FIG. 26 and FIG. 27 show a helmet configuration which utilizes a locking mechanism 7 to secure the protective barrier 8, and the protective helmet 21. The locking mechanism 7 and use of either a latch 10 or an extended flexible component 17 enables the protective barrier 8, to be rotated upwards. This enables easy removal of the protective helmet 21, and access to the wearer's facial area in the event of an injury.

The protective barrier 8 may be secured to a pivot mechanism such as a hinge or another flexible component at the front top of the helmet and attached on each side of the protective helmet 21 with a locking mechanism 7. When the button 13, of the locking mechanism 7, is suppressed or pushed in, the latch 10 or an extended flexible component 17 is released and enables the protective barrier 8, to be pivoted and rotated off the wearer's face or removed. When the protective barrier 8 is pivoted or rotated open or removed, making the protective helmet 21 easier to remove from the wearer's head. If the wearer of the protective helmet 21 suffers a head, facial, or neck injury, the person treating the wearer's injury will want to remove the protective helmet 21. Typically, several screws or bolts must be removed to enable the protective barrier 8, to be pivoted off the wearer's face. Removing screws or bolts requires a screwdriver, which may or may not be available. In addition, even if a screwdriver is available, it takes time and time may be of essence. In seconds, the protective barrier 8 can be removed by "pushing in" the button 13 of the locking mechanism 7. FIG. 26 and FIG. 27 show one variation of an embodiment of the protective helmet 21 with the locking mechanism 7 and protective barrier 8 connected in this manner.

Figure 29:
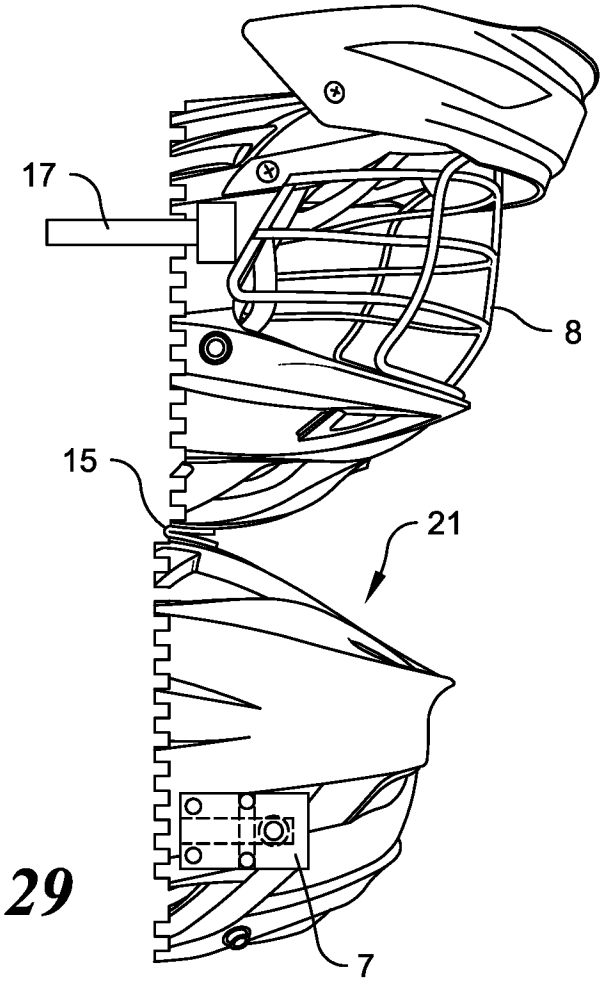
FIG. 29 shows a side elevational view of an alternate embodiment of a protective helmet 21 in an open position.
Figure 28:
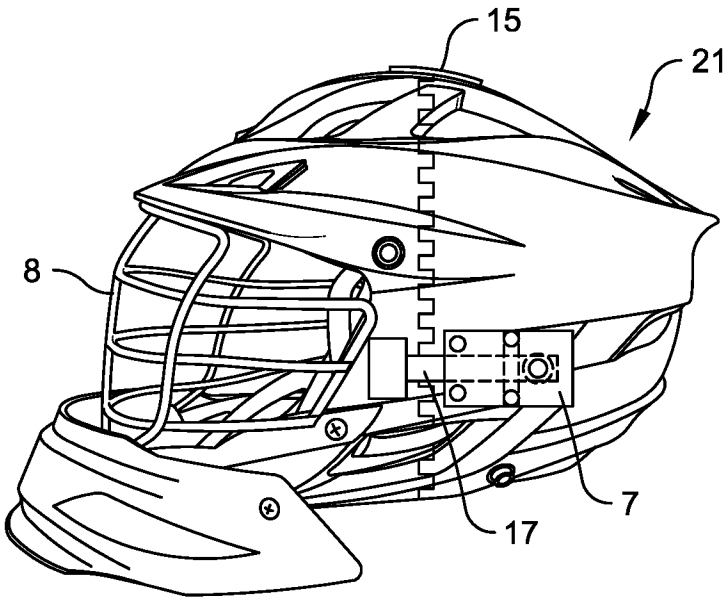
FIG. 28 shows a side elevational view of an alternate embodiment of a protective helmet in a closed position.

FIG. 28 and FIG. 29 show another embodiment of the protective helmet 21 in which the entire frontal portion of the helmet can rotate away from the wearer's face. FIG. 28 shows a left side view of a helmet with a hinge 15, on its top and a locking mechanism 7, on each side of the helmet with an extended flexible component 17. FIG. 29 shows a left side view of a protective helmet 21 with the locking mechanism 7 and the extended flexible component 17 unlocked and the helmet swung open and held together by a hinge 15. One of the advantages of this design is that it allows easy removal of the protective helmet 21 to allow quick and easy access to the wearer of the protective helmet 21 in the event of an injury, especially severe face and/or neck injury. FIG. 28 and FIG. 29 show an alternate embodiment of the protective helmet 21 with the locking mechanism 7.

Figure 30:
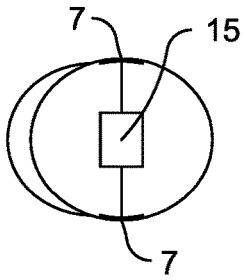
FIG. 30 shows a top plan view of an alternate embodiment of a protective helmet in a closed position.
Figure 31:
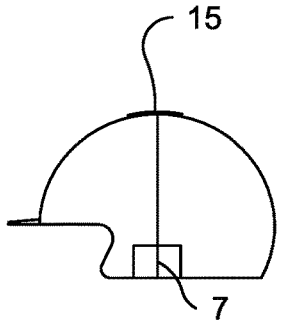
FIG. 31 shows a side elevational view of an alternate embodiment of a protective helmet in a closed position.
Figure 32:
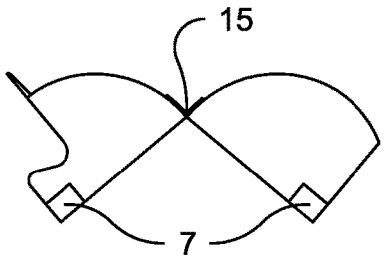
FIG. 32 shows a side elevational view of an alternate embodiment of a protective helmet in an open position.

FIGS. 30, 31, and 32 show an alternate embodiment of a protective helmet 21 without a protective barrier in front of the wearer's face. This type of helmet may be used in other sports, for example, a baseball batting helmet where a protective facial barrier is not typically used. FIG. 30 shows a top view of a protective helmet 21 with a hinge 15, on its top and a locking mechanism 7 with a latch 10 or extended flexible component 17 on each side of the protective helmet 21. FIG. 31 shows a side view of a protective helmet 21 with a hinge 15, on its top and a locking mechanism 7, on each side of the protective helmet 21. FIG. 32 shows a left side view of a protective helmet 21 with the locking mechanism 7, unlocked and the protective helmet 21 swung open and held together by a hinge 15. One of the advantages of this design is that it enables easy removal of the protective helmet 21 to allow quick and easy access to the wearer of the protective helmet 21 in the event of an injury, especially severe face and/or neck injury.

In another aspect of this patent application, an adjustment locking mechanism 16 is installed on the second flexible layer helmet shell 9 (an inner helmet shell closest to the head of a wearer). The adjustment locking mechanism 16 is typically position on the middle of the lower back of the second flexible layer helmet shell 9. The adjustment locking mechanism 16 is intended to obtain a tighter and more secure fit of the second flexible layer helmet shell 9 on the wearer head. When the adjustment locking mechanism 16 is opened, it enables easier removal of the protective helmet 21. The adjustment locking mechanism 16 can be adjusted to any position between fully opened and closed.

Figure 33:
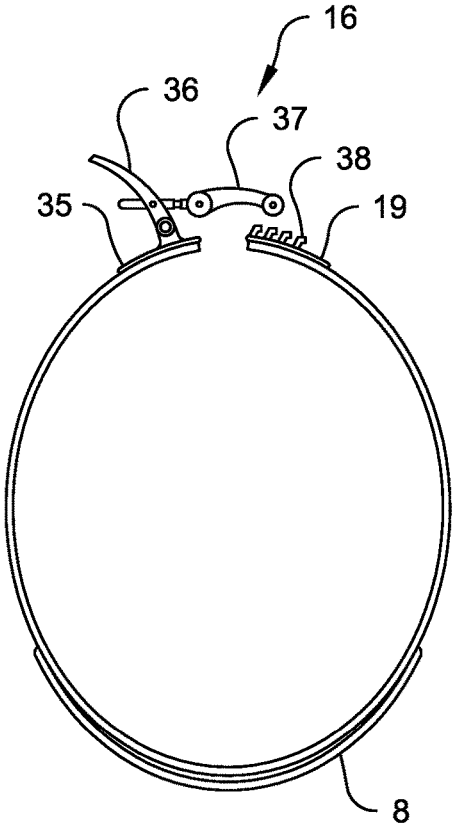
FIG. 33 shows a cross sectional view taken at line IV of FIG. 40 of a helmet shell with an adjustment locking mechanism in an open position.
Figure 34:
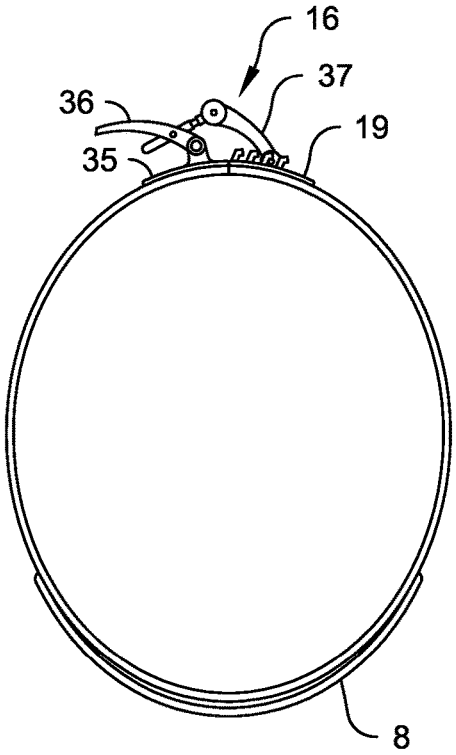
FIG. 34 shows a cross sectional view taken at line IV of FIG. 40 of a helmet shell with an adjustment locking mechanism in a closed position.
Figure 40:
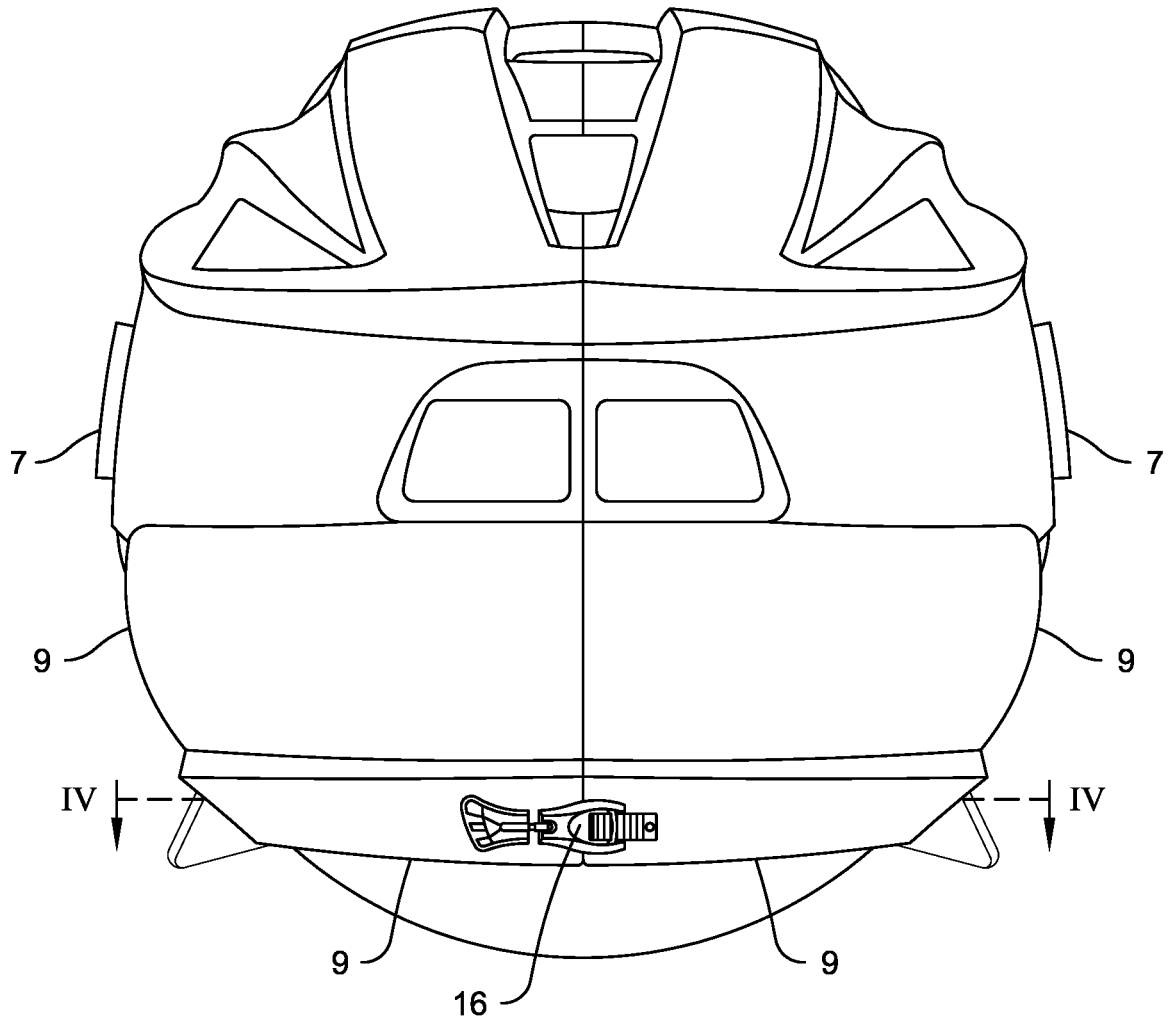
FIG. 40 shows a rear elevational view of a protective helmet incorporating an adjustment locking mechanism.

FIG. 33 and FIG. 34 shows an adjustment locking mechanism 16 for the second helmet shell 9 with a flexible Layer 4 with view taken at line IV in FIG. 40. The adjustment locking mechanism 16, would typically be position on the middle of the lower back of the second helmet shell 9 with a flexible layer 4. FIG. 33 shows the adjustment locking mechanism 16, in the open position where the second helmet shell 9 with a flexible layer 4 is fully opened. FIG. 34 shows the adjustment locking mechanism 16, in the closed position the second helmet shell 9 with a flexible layer 4 is closed. When adjustment locking mechanism 16 is in the open position, lever 36 is up and connected to engager 37. Lever 36 is also attached to secured base 35 as shown. Engager 37 may be inserted into one of several spaced teeth 38 in toothed base 19. As lever 36 is pulled down toward the closed position, it pulls on engager 37 which pulls toothed base 19 closer to secured base 35. Toothed base 19 and secured base 35 are attached to two segments of flexible layer 4 separated by a gap. As toothed base 19 and secured base 35 are pulled closer together, the segments of flexible layer are pulled together, tightening flexible layer 4 around the head of the wearer.

Figure 35A:
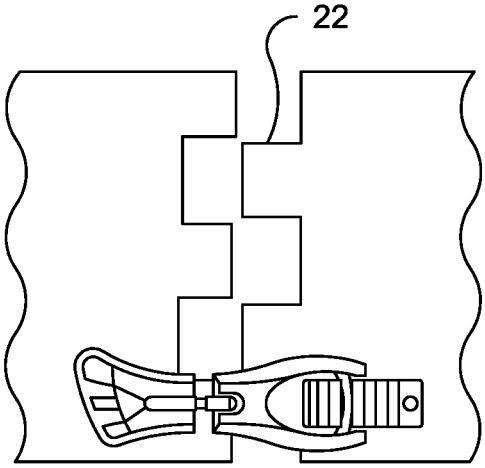
FIG. 35A shows a top plan view of an adjustment locking mechanism on a flexible layer of a second helmet shell with intermeshing notches in the open position.
Figure 36A:
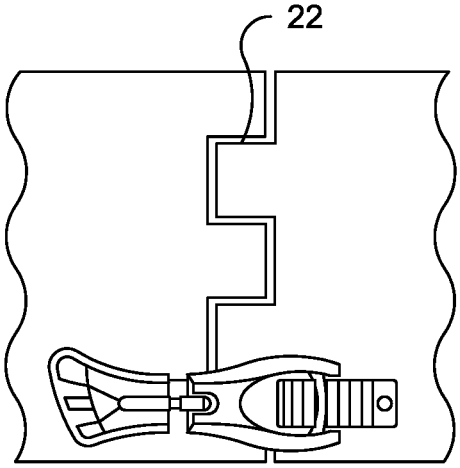
FIG. 36A shows a top plan view of an adjustment locking mechanism on a flexible layer of a second helmet shell with intermeshing notches in the closed position.
Figure 35B:
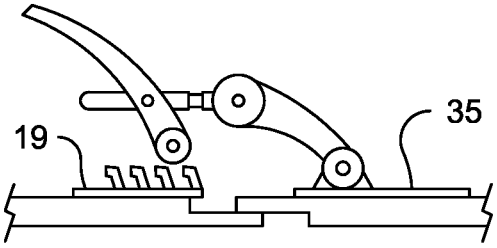
FIG. 35B shows a side elevational view of an adjustment locking mechanism in the open position.
Figure 36B:
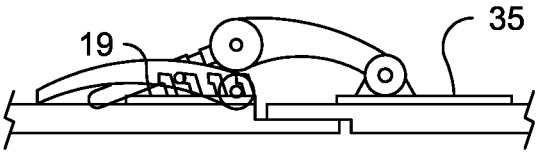
FIG. 36B shows a side elevational view of an adjustment locking mechanism in the closed position.

FIG. 35 and FIG. 36 show a portion of a helmet shell 9 of a protective helmet as seen in FIG. 40, although the second helmet shell 9 in FIG. 40 is not depicted with intermeshing notches. As shown in FIGS. 35 and 36, portions of a second helmet shell 9 may come together and maintain their alignment through intermeshing notches. An adjustment locking mechanism 16 may secure and hold together the segments of the helmet shell 9. The second helmet shell 9 with a flexible layer 4 may be configured with intermeshing notches 22 that can be any geometric shape that will intermesh to provide protection when in the open position and to enable closing of the second helmet shell 9 with a flexible layer 4 without overlapping the second helmet shell 9 with a flexible layer 4 upon itself. The adjustment locking mechanism 16 may also be positioned on the middle of the low back of the second helmet shell 9 with a flexible layer 4. FIG. 35 shows the adjustment locking mechanism 16, in the open position where the second helmet shell 9 with a flexible layer 4 is fully opened. The second helmet shell 9 with a flexible layer 4 in FIG. 36 shows the adjustment locking mechanism 16, in the closed position where the second helmet shell 9 with a flexible layer 4 is completely closed. The adjustment locking mechanism 16 can be adjusted to any position between fully opened and closed.

Figure 37:
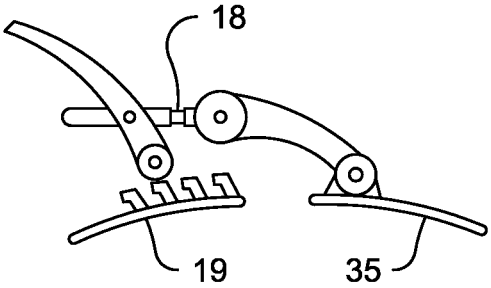
FIG. 37 shows a side elevational view of an alternate embodiment of an adjustment locking mechanism with adjustable thread screw in the open position.
Figure 38:
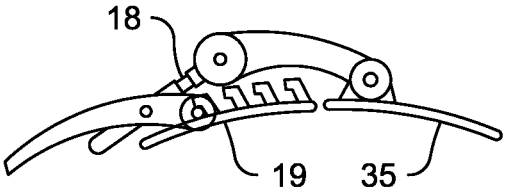
FIG. 38 shows a side elevational view of an alternate embodiment of an adjustment locking mechanism with adjustable thread screw in the closed position.

FIG. 37 and FIG. 38 show an alternative design for an adjustment locking mechanism 16. In this embodiment, thread screw 18 enables the adjustment of the distance between toothed base 19 and secured base 35. Adjustment locking mechanism 16 operates in a manner as described above; however, in addition, thread screw 18 may be turned clockwise or counterclockwise to provide a fine adjustment to the level of tightness of flexible layer 4 around the head of the wearer. While two different design configurations are disclosed in this patent application, there are several variations to them.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

We claim:

1. A protective helmet comprising a helmet shell having at least two layers and one of the at least two layers of the helmet shell having a flexural modulus from 50 MPa to 600 MPa as measured using ASTM D 790 B and a non-foamed specific gravity in a range of 0.916 g/cm$^3$ up to 1.60 g/cm$^3$.

2. The protective helmet of claim 1 wherein each of the at least two layers is constructed of a material selected from the group consisting of polystyrene, polypropylene, polyethylene, thermoplastic polyurethane, thermoplastic elastomers, thermoplastic polymer, vulcanized polymer, silicone polymers, EPDM polymers, natural rubber, neoprene, polyurethane foam, and polyurethane.

3. The protective helmet of claim 2 wherein the material in each of the at least two layers is crosslinked with materials selected from the group consisting of a low density polyethylene foam, a polyurethane foam, and an ethylene-vinyl acetate copolymer.

4. The protective helmet of claim 1 wherein the at least two layers are comprised of materials selected from the group consisting of a slightly foamed layer, a cushion layer, a waterproof coating layer, a flexible layer, and a separator layer.

5. The protective helmet of claim 1 wherein the at least two layers is comprised of an open cell foam.

6. The protective helmet of claim 1 wherein one of the at least two layers is a cushion layer comprised of multiple elongated foam shapes.

7. The protective helmet of claim 1 wherein one of the at least two layers is a cushion layer having a thickness in a range from 0.032 inches to 1.25 inches.

8. The protective helmet of claim 1 wherein one of the at least two layers is a waterproof coating layer comprised of a thermoplastic film adhered to a cushion layer.

9. The protective helmet of claim 1 wherein one of the at least two layers is a separator layer containing air spaces or channels throughout the separator layer.

10. The protective helmet of claim 1 wherein one of the at least two layers is a flexible layer and further comprising rigid particles adhered to the flexible layer and raised above the surface of the flexible layer.

11. The protective helmet of claim 1 wherein the helmet shell has an external side and an internal side, and further comprising removable and repositionable cushion layers pads attached to the internal side of the helmet shell.

12. The protective helmet of claim 1 wherein the helmet shell is configured to enclose all sides of a head of a wearer except the face and further comprising a protective barrier attached to the helmet shell and covering the face.

13. A protective helmet comprising a helmet shell having at least two layers and one of the at least two layers of the helmet shell having a flexural modulus from 50 MPa to 600 MPa as measured using ASTM D 790 B and a non-foamed specific gravity in a range of 0.916 g/cm$^3$ up to 1.60 g/cm$^3$, the protective helmet being configured to enclose all sides of a head of a wearer except the face and further comprising a protective barrier attached to the helmet shell and covering the face, and the protective helmet further comprising at least one locking mechanism, the locking mechanism comprising an extended flexible component or latch attached to the protective barrier, the extended flexible component or latch configured to slide into a fixture assembly attached to the helmet shell and engage a hook within the fixture assembly, and a button in the fixture assembly in contact with the extended flexible component or latch for moving the extended flexible component or latch away from the hook to permit the protective barrier to move away from the helmet shell.

14. A protective helmet comprising a helmet shell having at least two layers and one of the at least two layers of the helmet shell having a flexural modulus from 50 MPa to 600 MPa as measured using ASTM D 790 B and a non-foamed specific gravity in a range of 0.916 g/cm$^3$ up to 1.60 g/cm$^3$, the protective helmet being configured to enclose all sides of a head of a wearer except the face and further comprising a protective barrier attached to the helmet shell and covering the face, and the protective helmet further comprising at least one locking mechanism, the locking mechanism comprising an extended flexible component or latch attached to the protective barrier, the extended flexible component or latch configured to slide into a fixture assembly attached to the helmet shell and engage a hook within the fixture assembly, and a button in the fixture assembly in contact with the extended flexible component or latch for moving the extended flexible component or latch away from the hook to permit the protective barrier to move away from the helmet shell and the protective helmet further comprising a hinge or flexible component attached to the protective barrier and the helmet shell whereby the protective barrier is capable of being rotated upward away from the face of the wearer.

15. The protective helmet of claim 1 wherein the helmet shell further comprises a front section and the rear section, the front section being connected to the rear section with a hinge whereby the front section of the helmet shell is capable of being rotated upward and away from the rear section.

16. The protective helmet of claim 1 wherein one of the at least two layers is a cushion layer with a IFD/ILD of 20 pounds to 200 lbs. as measured by ASTM D3574.

17. The protective helmet of claim 1 wherein one of the at least two layers is a cushion layer with a IFD/ILD of 60 lbs. to 70 lbs. as measured by ASTM D3574.

* * * * *